US008052474B2

(12) United States Patent
Fite et al.

(10) Patent No.: US 8,052,474 B2
(45) Date of Patent: Nov. 8, 2011

(54) PLUG/JACK SYSTEM HAVING PCB WITH LATTICE NETWORK

(75) Inventors: Wayne C. Fite, Elmhurst, IL (US); Ronald A. Nordin, Naperville, IL (US); Masud Bolouri-Saransar, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 13/007,922

(22) Filed: Jan. 17, 2011

(65) Prior Publication Data

US 2011/0111630 A1 May 12, 2011

Related U.S. Application Data

(63) Continuation of application No. 12/050,550, filed on Mar. 18, 2008, now Pat. No. 7,874,878.

(60) Provisional application No. 60/895,853, filed on Mar. 20, 2007.

(51) Int. Cl.
*H01R 13/66* (2006.01)

(52) U.S. Cl. ..... 439/620.21

(58) Field of Classification Search ..... 439/620.21, 439/188, 676, 76.1, 490, 638, 660
See application file for complete search history.

(56) References Cited

U.S. PATENT DOCUMENTS 7,874,878 B2 * 1/2011 Fite et al. ..... 439/676

* cited by examiner

*Primary Examiner* — Jean Duverne
(74) *Attorney, Agent, or Firm* — Robert A. McCann; Zachary J. Smolinski

(57) ABSTRACT

A jack is provided that has compensation and crosstalk zones. At least one of the zones employs a lattice network that couples conductors in the zone to reduce the net crosstalk in the plug/jack system. The lattice network has a frequency response slope that is different from the frequency response slope of a first-order coupling or of a series LC circuit coupling. A variety of lattice networks are provided.

11 Claims, 27 Drawing Sheets

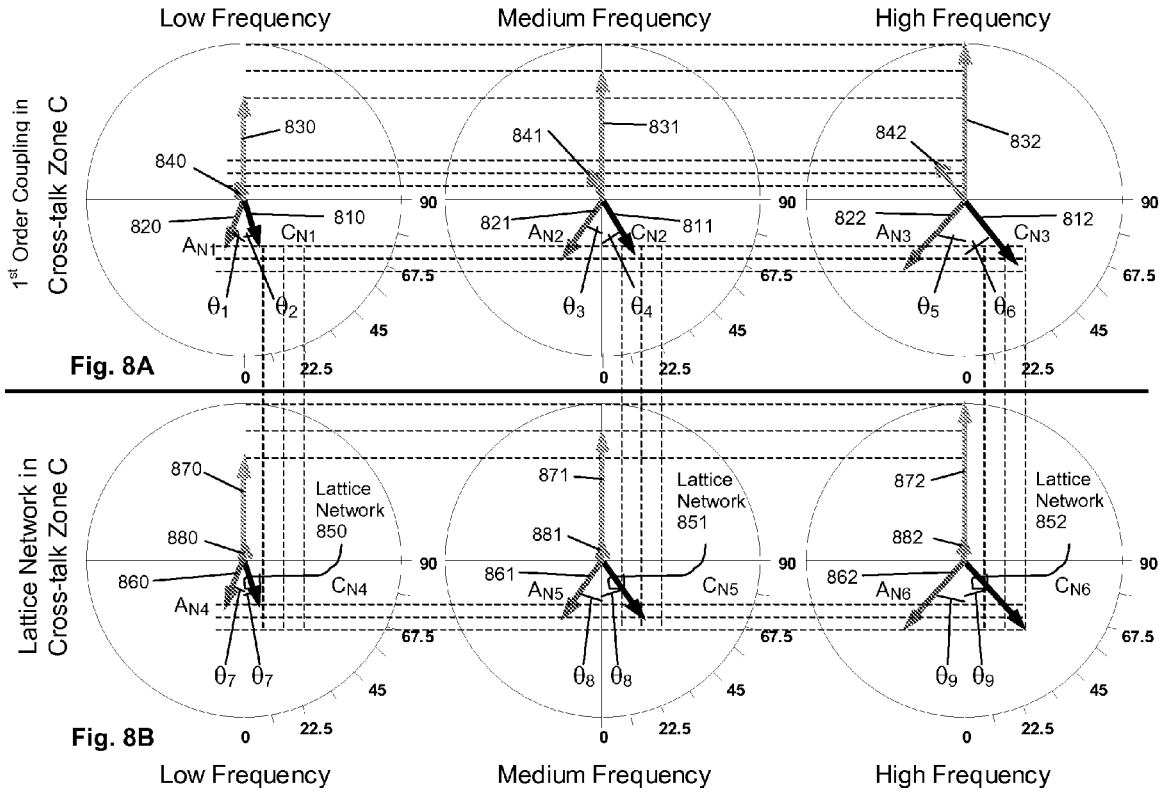
Low Frequency
Medium Frequency
High Frequency
1st Order Coupling in Cross-talk Zone C
830
840
820
810
$A_{N1}$
$C_{N1}$
$\theta_1$
$\theta_2$
841
831
821
$A_{N2}$
$C_{N2}$
811
$\theta_3$
$\theta_4$
842
832
822
$A_{N3}$
$C_{N3}$
812
$\theta_5$
$\theta_6$
90
67.5
45
22.5
0
Fig. 8A
Lattice Network in Cross-talk Zone C
870
880
860
$A_{N4}$
$C_{N4}$
Lattice Network 850
$\theta_7$ $\theta_7$
871
881
861
$A_{N5}$
$C_{N5}$
Lattice Network 851
$\theta_8$ $\theta_8$
872
882
862
$A_{N6}$
$C_{N6}$
Lattice Network 852
$\theta_9$ $\theta_9$
Fig. 8B
Low Frequency
Medium Frequency
High Frequency

PLUG/JACK SYSTEM HAVING PCB WITH LATTICE NETWORK

CROSS-REFERENCE TO OTHER APPLICATIONS

The present application is a continuation of U.S. patent application Ser. No. 12/050,550 filed Mar. 18, 2008, which claims priority to U.S. Provisional Patent Application No. 60/895,853, filed Mar. 20, 2007. The present application incorporates by reference in its entirety U.S. Pat. No. 7,153,168, issued on Dec. 26, 2006 and entitled "Electrical Plug/Jack System with Improved Crosstalk Compensation."

BACKGROUND

1. Technical Field

The present application relates to a plug/jack system, and in particular, a plug/jack system containing a lattice network to reduce crosstalk in the plug/jack system.

2. Description of Related Art

In the communications industry, as data transmission rates have steadily increased, crosstalk due to capacitive and inductive couplings among the closely spaced parallel conductors within a jack and/or plug has become increasingly problematic. Modular plug/jack systems with improved crosstalk performance have been designed to meet increasingly demanding standards. Many of these improved plug/jack systems have included concepts disclosed in U.S. Pat. No. 5,997,358, the entirety of which is incorporated by reference herein. In particular, recent plug/jack systems have introduced predetermined amounts of crosstalk compensation to cancel offending crosstalk. Two or more zones of compensation are used to account for phase shifts between the compensation and the crosstalk. As a result, the magnitude and phase of the offending crosstalk is offset by the compensation, which, in aggregate, has an equal magnitude, but opposite phase.

Recent transmission rates have exceeded the capabilities of the techniques disclosed in U.S. Pat. No. 5,997,358. Thus, improved compensation techniques were needed.

SUMMARY

A plug/jack system with multiple zones is provided. These zones include a contact zone, a compensation zone, and a crosstalk zone. In the contact zone, plug contacts of a plug connect with jack spring contacts of a jack at plug/jack interfaces of the jack spring contacts. The contact zone provides crosstalk in the plug/jack system. The compensation zone provides a compensation signal that compensates for the crosstalk in the plug/jack system. The crosstalk zone in the jack adds additional phase-delayed crosstalk. A PCB connected to the jack spring contacts contains the crosstalk zone. The compensation zone may be provided, for example, in the PCB containing the crosstalk zone, in a PCB disposed between the plug/jack interfaces and the PCB containing the crosstalk zone, and/or by shaping the jack spring contacts. Conductors in the compensation and crosstalk zones are connected to the jack spring contacts. At least one of the compensation and crosstalk zones contains a coupling between first and second pairs of conductors that can be modeled as a lattice network. The lattice network includes a crosstalk circuit component and a compensation circuit component each of which has a different coupling rate vs. frequency. In one embodiment, the lattice network includes a series LC circuit between a first conductor of the first pair of conductors and a first conductor of the second pair of conductors and a series LC circuit between a second conductor of the first pair of conductors and a second conductor of the second pair of conductors. The lattice network also contains a shunt capacitor between the first conductor of the first pair of conductors and the second conductor of the second pair of conductors and a shunt capacitor between the second conductor of the first pair of conductors and the first conductor of the second pair of conductors. The coupling frequency response slope of the lattice network is designed to be higher or lower than the coupling frequency response slope of a first-order coupling (such as a purely capacitive coupling) depending on the zone in which the lattice network is disposed.

BRIEF DESCRIPTION OF THE DRAWINGS

Exemplary embodiments are described below with reference to the attached drawings.

FIGS. 8A and 8B illustrate a simplified vector model of an RJ45 plug and jack three-zone system at various frequencies when a first-order coupling and a lattice network, respectively, are used in the crosstalk zone.

DETAILED DESCRIPTION OF EMBODIMENTS

The data transmission rates used in communications systems are continually increasing. This increase has increased crosstalk in the plug/jack system. Accordingly, various methods have been used to decrease the net crosstalk in the system. One of these methods includes providing at least one printed circuit board (PCB) in the jack to compensate for crosstalk, reducing the net near end crosstalk (NEXT) in the system. According to some embodiments, reducing the net NEXT in a plug/jack system also results in a reduction of the net far end crosstalk (FEXT).

One type of electrical connector typically used in a communication system is an RJ45 connector. The standard pin configuration for an eight wire RJ45 plug/jack system contains multiple conductive pairs. These multiple pairs include a split pair (conductors 3 and 6) that straddles an intermediate pair (conductors 4 and 5). Signals introduced to the split pair are capacitively and inductively coupled to the intermediate pair due to the physical proximity of conductors in both the plug and jack. The unintentional coupling introduced to the jack in the proximity of the plug/jack interface is crosstalk. The area in which this coupling occurs is hereinafter referred to as the contact zone.

Figure 1A:
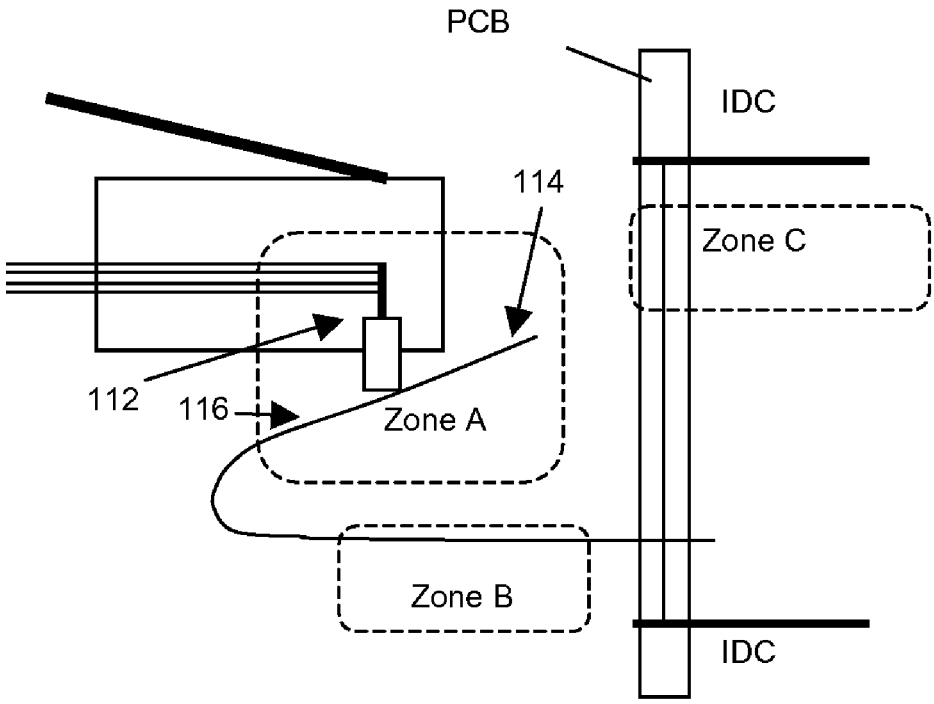
FIGS. 1A and 1B are simplified block diagrams of a plug/jack compensation system.
Figure 1B:
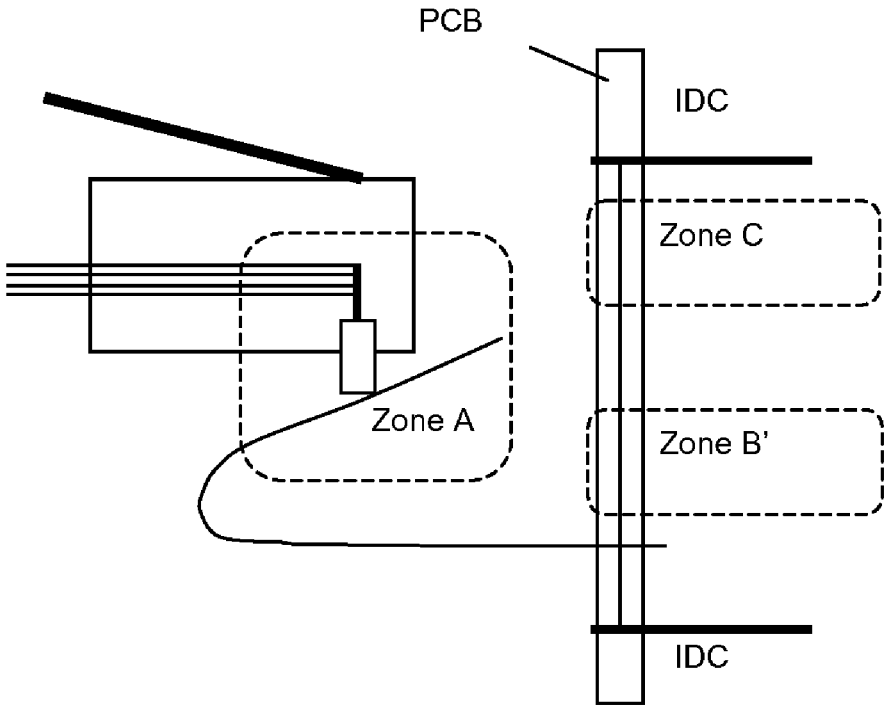

To compensate for the crosstalk resulting from the above coupling, capacitive and inductive coupling between different conductor pairs is intentionally introduced in different zones along the transmission path in the plug/jack system. FIGS. 1A and 1B illustrate cross-sectional views of different embodiments of a plug/jack system. In both FIGS. 1A and 1B, plug contacts of the plug connect with jack spring contacts of the jack at plug/jack interfaces of the jack spring contacts in Zone A (the contact zone). The jack spring contacts extend from the plug/jack interfaces to connect to a PCB containing Zone C (hereafter referred to as the crosstalk zone). Conductive traces on the PCB extend between the jack spring contacts and insulation displacement contacts (IDCs) attached to the PCB. As shown in FIG. 1A, Zone B (hereafter referred to as the compensation zone) is disposed between the contact zone and the crosstalk zone. The compensation zone may be realized using a PCB or individual elements attached to the jack spring contacts and/or by altering the shape of the jack spring contacts. The PCBs in connectors according to at least some embodiments may be rigid PCBs, flexible PCBs, or combinations of the two. As shown in FIG. 1B, the compensation zone (Zone B') may also be disposed in the PCB containing the IDCs. Zone B' is electrically more proximate to the contact zone than the crosstalk zone (Zone C) is to the contact zone.

As discussed above, crosstalk is unintentionally introduced in the contact zone. Supplemental crosstalk is intentionally added in the crosstalk zone. The compensation zone introduces compensation, which compensates for the combined crosstalk from the contact and crosstalk zones. The addition of crosstalk in the crosstalk zone permits the compensation zone of the jack to better compensate for crosstalk in the contact zone by introducing phase-delayed crosstalk to the jack/plug system, as described more thoroughly below and in U.S. Pat. No. 7,153,168. Although either the embodiment shown in FIG. 1A or FIG. 1B may be used, the effectiveness of compensation at the compensation zone increases with increasing proximity to the contact zone due to the decreased phase delay between the crosstalk introduced in the contact zone and the compensation introduced at the compensation zone.

Figure 2:
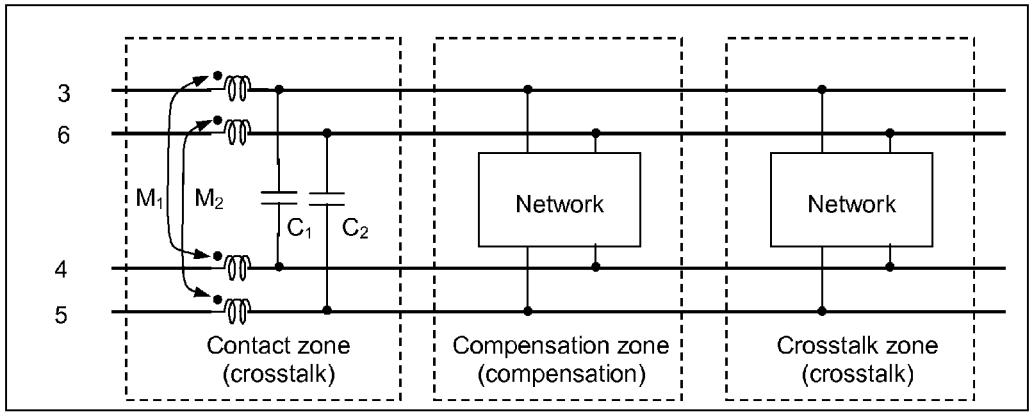
FIG. 2 illustrates a schematic model of the three-zone plug and jack system of FIGS. 1A and 1B, showing only wires 3, 4, 5, and 6.

The coupling in each zone is modeled as a network between the conductors. Networks contain circuits between pairs of coupled conductors. Each circuit contains one or more circuit elements. The conductors can include jack spring contacts or conductive traces on the PCB. The capacitive and inductive coupling in each of the compensation and crosstalk zones may be provided by distributed elements, such as PCB traces that run parallel to each other or the jack spring contacts, or by individual physical components between the jack spring contacts or traces. If the capacitive and inductive couplings are provided by distributed elements, the coupling in a particular section may be modeled as a circuit containing lumped elements as long as the section is small compared to the wavelength of the maximum frequency to be analyzed. Generally, the physical size of the section should be less than about 1/20 of the wavelength of the signal to use this approach. For example, if purely distributed capacitive coupling or purely distributed inductive coupling exists between a conductor pair, such coupling may be modeled by the use of a single capacitor or inductor, respectively, between the conductor pair. The contact zone contains a combination of a distributed mutually inductive coupling and a distributed capacitive coupling between conductor pairs which results in multiple first-order couplings, as shown in FIG. 2. The magnitude of a first-order coupling, such as a purely capacitive coupling, has a frequency dependence of approximately 20 dB per decade. The lumped-element model is appropriate for the normal operating frequency range of the plug/jack system. Thus, the lumped-element model will be used to describe the circuit elements of various circuits discussed herein.

FIG. 2 illustrates a schematic model of the three-zone plug/jack system of FIGS. 1A and 1B, showing only conductors 3, 4, 5, and 6 for clarity. Each of the three zones includes capacitive and inductive circuit elements, shown in the compensation and crosstalk zones as a block containing a network. The contact zone includes capacitive and inductive coupling from the plug wires and contacts (112 in FIG. 1A), capacitive coupling resulting from the jack spring contacts extending from the plug/jack interface to the end of the jack spring contacts away from the PCB (114 in FIG. 1A), and capacitive and inductive coupling from the jack spring contacts extending from the plug/jack interface towards the PCB (116 in FIG. 1A). These elements are shown as capacitive and mutual inductive coupling between conductors 3 and 4 and between conductors 6 and 5. The amount of each of the capacitance and mutual inductance may be different between the two coupled pairs. Similar coupling may occur between the conductors in the compensation and crosstalk zones.

The coupling shown in the contact zone of FIG. 2 is a first-order coupling. Although the use of similar first-order couplings in the compensation and crosstalk zones may provide some ability to reduce the crosstalk, such couplings have limitations in crosstalk reduction. Other networks may be employed to better reduce the crosstalk. In particular, a lattice network having multiple frequency-dependent couplings may be used in the compensation and/or crosstalk zones to provide compensation and crosstalk coupling.

One embodiment of a lattice network contains an inductance and capacitance in series (i.e., a series LC circuit) between two sets of conductor pairs and a shunt capacitance between two other sets of conductor pairs. This embodiment of a lattice network is modeled as two series LC circuits in a crosstalk configuration (one between conductor pair 3-4 and the other between conductor pair 5-6) and two shunt capacitors in a compensation configuration (one between conductor pair 3-5 and the other between conductor pair 4-6). The lattice network can be employed in either or both of the compensation zone and the crosstalk zone.

Comparing the lattice network to first-order couplings: the frequency response slope of the lattice network is tunable and may be either higher or lower, the phase shift of the lattice network changes with frequency to a greater extent, and the resonant frequency of the lattice network may be designed as desired. Similarly, comparing the lattice network to a series LC circuit alone in a crosstalk configuration: the frequency response slope of the lattice network may be adjusted more flexibly, the phase shift of the lattice network changes with frequency to a greater extent, and the inductance used in the lattice network can be smaller which permits the physical layout of the traces on the PCB providing the inductance to be reduced in size. The use of the lattice network permits improved frequency shaping of the crosstalk response of the plug/jack system.

Figure 3:
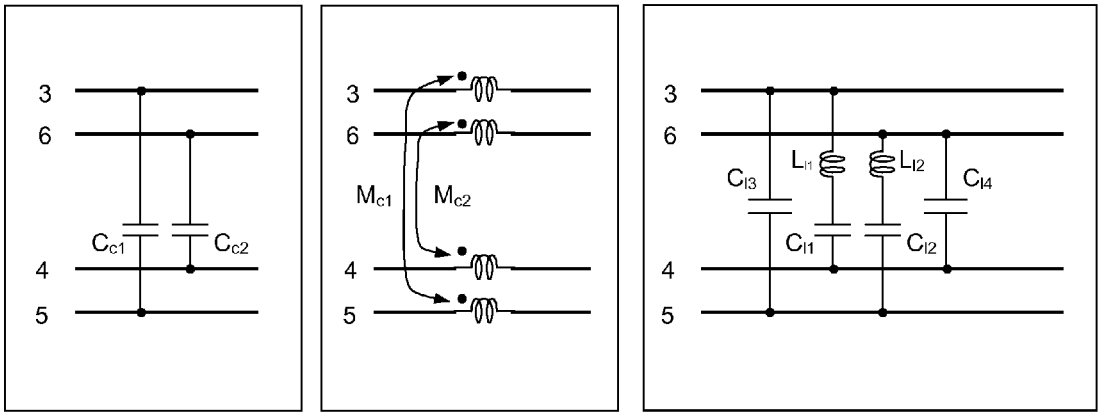
FIGS. 3(*i*), 3(*ii*), and 3(*iii*) show a circuit model schematic having capacitive coupling only, mutual inductive coupling only, and a lattice network, respectively, in the compensation zone.
Figure 4:
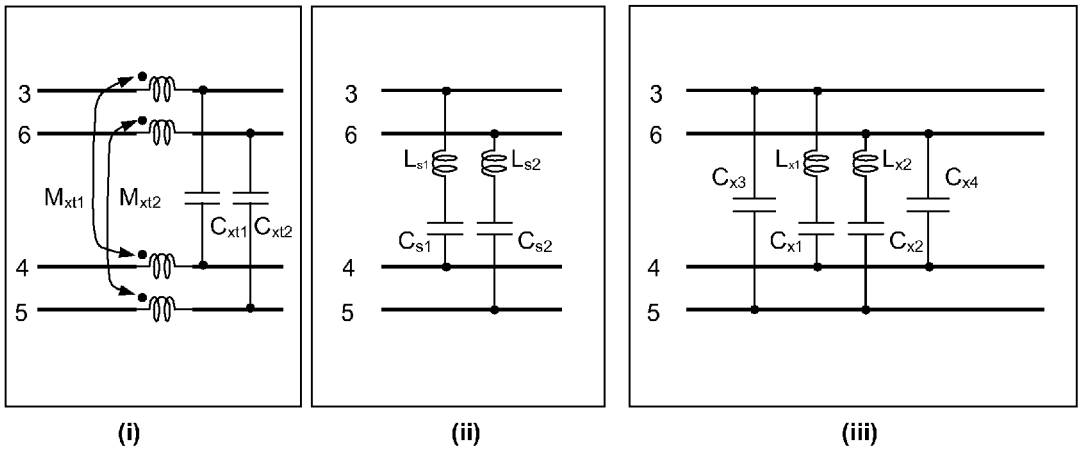
FIGS. 4(*i*), 4(*ii*), and 4(*iii*) show a circuit model schematic having capacitive coupling and mutual inductive coupling, series LC circuit couplings, and a lattice network, respectively, in the crosstalk zone.

FIGS. 3 and 4 show SPICE (Simulation Program with Integrated Circuit Emphasis) circuit model schematics for various embodiments of networks in the compensation zone and the crosstalk zone, respectively. As above, in one embodiment, each of the networks in FIGS. 3 and 4 may be provided by traces on a PCB, with the coupling between the traces represented as individual circuit elements. More specifically, FIGS. 3(*i*) and 3(*ii*) illustrate the use of purely capacitive or purely mutually inductive couplings, respectively, between conductors 3 and 5 and between conductors 4 and 6 in the compensation zone. Each of these couplings is modeled by a single element, either a capacitor ($C_{c1}$ and $C_{c2}$) or a mutual inductor ($M_{c1}$ and $M_{c2}$), between the conductors of each pair. FIG. 4(*i*) illustrates a combination of capacitors ($C_{xt1}$ and $C_{xt2}$) and mutual inductors ($M_{xt1}$ and $M_{xt2}$) coupling conductors 3 and 4 and coupling conductors 5 and 6 in the crosstalk zone, while FIG. 4(*ii*) shows a series inductor-capacitor (LC) circuit between conductors 3 and 4 and between conductors 5 and 6 in the crosstalk zone.

The series LC circuit between each pair of conductors in FIG. 4(*ii*) contains a capacitor, $C_{s1}$, in series with a self-inductance, $L_{s1}$, between conductor pairs 3 and 4. Likewise, $C_{s2}$ is in series with $L_{s2}$ between conductor pairs 5 and 6. A series LC circuit has a resonant frequency=$1/(2\pi*\sqrt{LC})$. At frequencies below the resonant frequency, the coupling provided by the series LC circuit increases as a function of frequency. At frequencies above the resonant frequency, the coupling provided by the series LC circuit decreases as a function of frequency.

FIGS. 3(*iii*) and 4(*iii*) show embodiments of the lattice network in the compensation zone and crosstalk zone, respectively. As illustrated, the lattice network includes a pair of series LC circuits in conjunction with shunt capacitances. One series LC circuit ($L_{l1}$ and $C_{l1}$ in FIG. 3(*iii*) and $L_{x1}$ and $C_{x1}$ in FIG. 4(*iii*)) is connected in a crosstalk configuration between conductors 3 and 4 and the other series LC circuit ($L_{l2}$ and $C_{l2}$ in FIG. 3(*iii*) and $L_{x2}$ and $C_{x2}$ in FIG. 4(*iii*)) is connected in a crosstalk configuration between conductors 5 and 6. In addition, one shunt capacitor ($C_{l3}$ in FIG. 3(*iii*) and $C_{x3}$ in FIG. 4(*iii*)) is connected in a compensation configuration between conductors 3 and 5 and the other shunt capacitor ($C_{l4}$ in FIG. 3(*iii*) and $C_{x4}$ in FIG. 4(*iii*)) is connected in a compensation configuration between conductors 4 and 6. In one embodiment of FIG. 3(*iii*), capacitors $C_{l3}$ and $C_{l4}$ are equal to each other and have a larger capacitance than capacitors $C_{l1}$ and $C_{l2}$, which are also equal to each other. In one embodiment of FIG. 4(*iii*), capacitors $C_{x3}$ and $C_{x4}$ are equal to each other but have a smaller capacitance than capacitors $C_{x1}$ and $C_{x2}$, which are also equal to each other. A lattice network may be implemented in the crosstalk zone as shown in FIG. 4(*iii*), for example, when the contact zone vector and the crosstalk zone vector are not balanced with respect to the compensation zone vector, as shown in FIG. 8A. This can happen when the magnitudes of the contact and crosstalk vectors are not equal and/or when the phase differences between the compensation vector and the contact and crosstalk vectors are not equal.

Figure 5A:
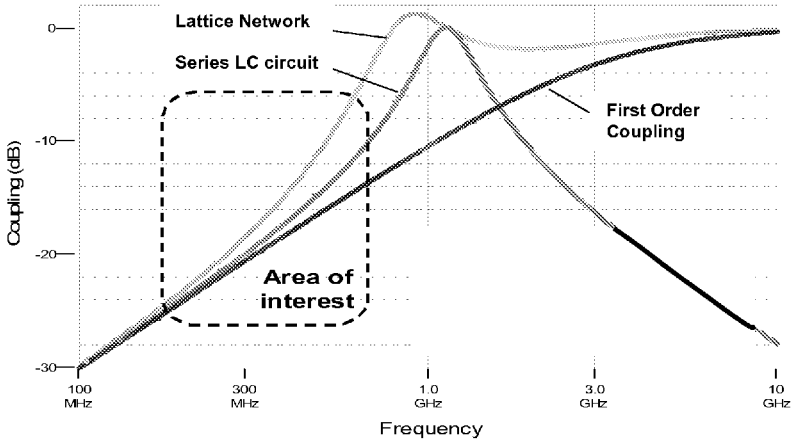
FIGS. 5A and 5B are simulations of the magnitude response and phase shift, respectively, of networks operating in the crosstalk zone.
Figure 5B:
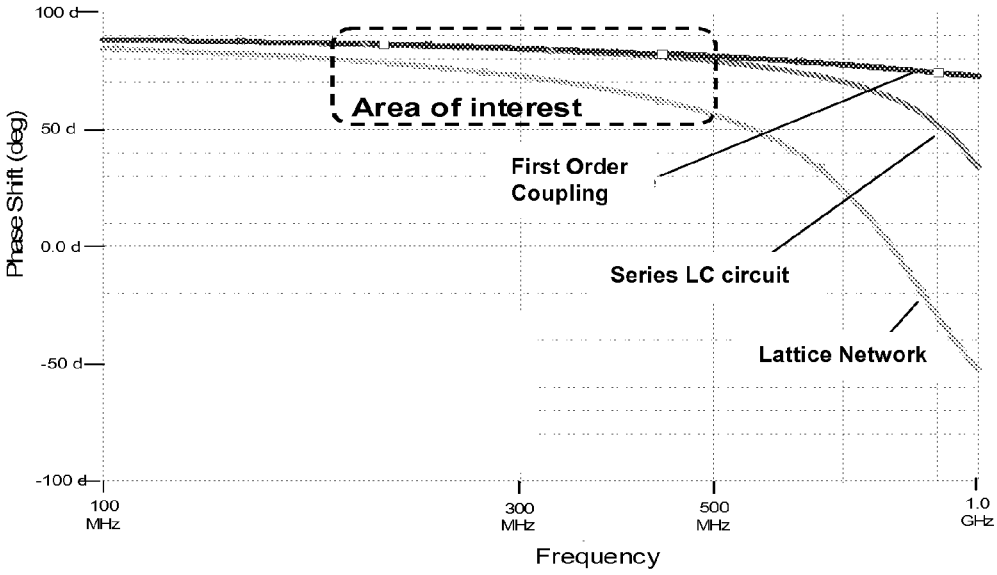

The capacitance and inductance of the series LC circuit alone and the lattice network may be designed such that the series LC circuit alone and the lattice network do not play a significant role in coupling at lower frequencies (e.g., less than about 100 MHz) but play an increasingly significant role at higher frequencies (e.g., greater than about 100 MHz) due to the presence of the series inductor. As an example, FIGS. 5A and 5B illustrate the responses of different networks in the crosstalk zone of the RJ45 plug/jack system. More specifically, FIGS. 5A and 5B compare the magnitude and phase shift, respectively, of a first-order coupling (capacitance only), a series LC circuit (as shown in FIG. 4(*ii*)), and a lattice network in the crosstalk zone (as shown in FIG. 4(*iii*)). The capacitance used in the simulation of the first-order coupling and the series LC circuit is 1 pF. Each crosstalk capacitance used in the simulation of the lattice network (i.e., the capacitance in the LC series circuit of the lattice network) is 1 pF and each compensation capacitance (i.e., the shunt capacitance in the lattice network) is 2 pF. Each inductance used in the simulations of the series LC circuit and the lattice network is 20 nH. The capacitance and inductance values given are for low frequencies (below about 50 MHz). A characteristic operating frequency range of the plug/jack system is denoted in FIGS. 5A and 5B as the dashed region entitled "area of interest" and extends from about 200 MHz to about 500 MHz. In the graph of FIG. 5A, the first-order coupling response has a slope of approximately 20 dB per decade in the area of interest. The series LC circuit has a resonance at approximately 1.1 GHz. Below resonance, the response of the series LC circuit has a slope of about 25 dB per decade. The slope of the response of the lattice network below resonance is larger (at about 30 dB per decade) than the response slope of the series LC circuit.

The phase shifts of the first-order coupling, the series LC circuit, and the lattice network in the crosstalk zone as a function of frequency are illustrated in FIG. 5B. The phase shifts of the first-order coupling and the series LC circuit in the area of interest are approximately the same. The phase shift of the lattice network changes with frequency to a greater extent than the phase shift of either the first-order coupling or the series LC circuit over the area of interest. The difference in magnitude and phase shift exhibited by the lattice network compared to the first-order coupling or the series LC circuit can be taken advantage of when compensating the plug/jack system. This is also shown in more detail using the vector diagrams of FIGS. 7 and 8 and described in more detail below.

Figure 6A:
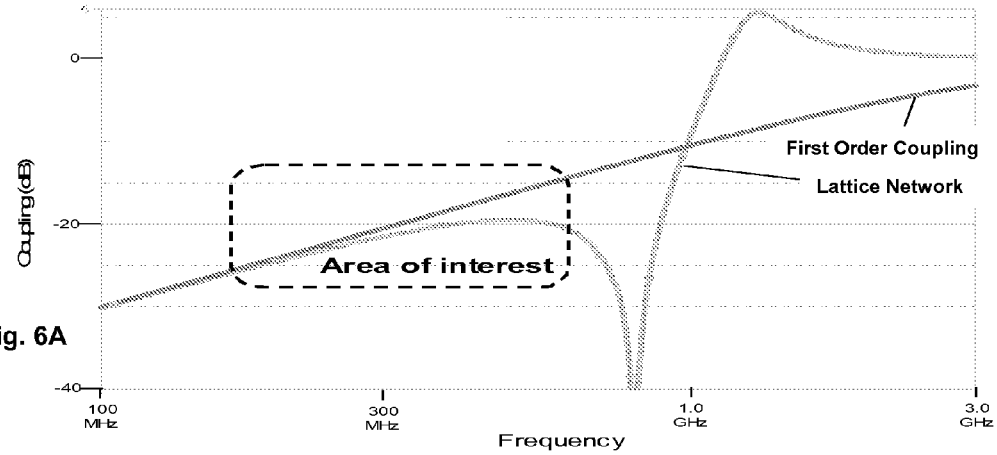
FIGS. 6A and 6B are simulations of the magnitude response and phase shift, respectively, of a lattice network and a first-order coupling operating in the compensation zone.
Figure 6B:
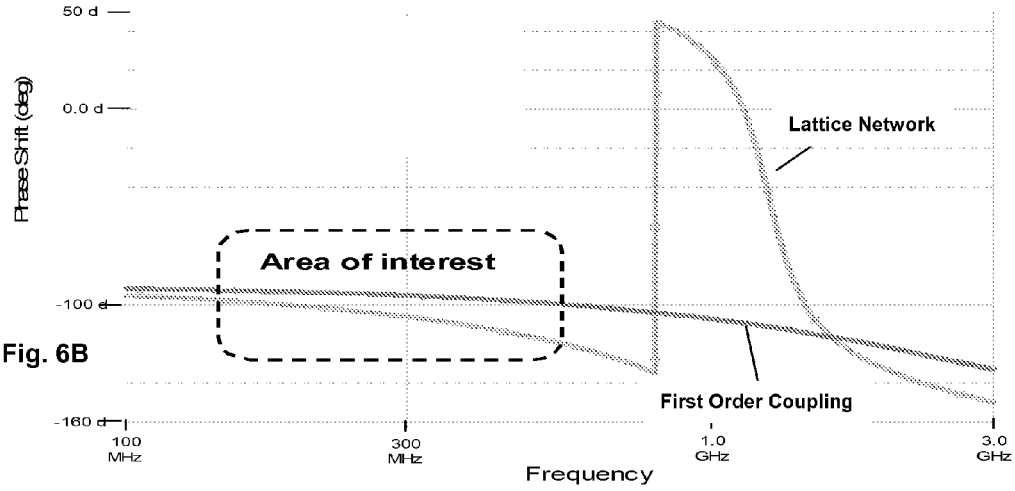

The magnitude response and phase shift of networks operating in the compensation zone of the RJ45 plug/jack system are illustrated in FIGS. 6A and 6B, respectively. In particular, FIGS. 6A and 6B illustrate the magnitude response and phase shift, respectively, of the lattice network (shown in FIG. 3(*iii*)) and the first-order (capacitive) coupling (shown in FIG. 3(*i*)). The values of the circuit elements used in the simulations in FIGS. 6A and 6B are the same as those used in FIGS. 5A and 5B except that each crosstalk capacitance used in the simulation of the lattice network is 2 pF and each compensation capacitance is 1 pF. The magnitude of the first-order coupling response shown in FIG. 6A has a slope of about 20 dB per decade. The magnitude of the lattice network response in the area of interest is smaller than that of the first-order coupling and has a slope that varies from about 20 dB per decade at the lower end of the area of interest to about 0 dB per decade at the higher end of the area of interest. As shown in FIG. 6B, the phase shift of the lattice network changes with frequency to a greater extent than the phase shift of the first-order coupling over the area of interest. The magnitude and phase shift of the lattice network are able to be more precisely tailored to better compensate for crosstalk than the first-order coupling or the series LC circuit.

FIGS. 7 and 8 illustrate vector models of a three-zone plug/jack system. The compensation and crosstalk from the contact zone, the compensation zone, and the crosstalk zone may be analyzed as a set of frequency-dependant vectors separated by a phase differences from a reference plane (which is nominally located at the effective center of the compensation zone). The phase differences depend on the physical distances between the couplings and also upon the materials through which the signals propagate. The contact zone contains multiple crosstalk terms that can be combined to form a single crosstalk vector that has a magnitude and a phase. Both the crosstalk from the contact zone and the crosstalk from the crosstalk zone have a phase difference from the compensation from the compensation zone. The vectors from the three zones may be summed together to calculate the frequency-dependant crosstalk.

The vector models of FIGS. 7 and 8 compare a first-order coupling to a lattice network implemented in the compensation zone and crosstalk zone, respectively. The relative magnitudes of the vectors are shown at different frequencies. Note that these figures show the magnitudes of the vectors relative to each other, the absolute magnitudes of the vectors increase with frequency over the area of interest. In FIGS. 7 and 8, low frequency refers to frequencies below about 50 MHz, medium frequency refers to frequencies between about 50 MHz and 200 MHz, and high frequency refers to frequencies above about 200 MHz. The relative magnitudes of the vectors are shown at different frequencies.

Figure 7A:
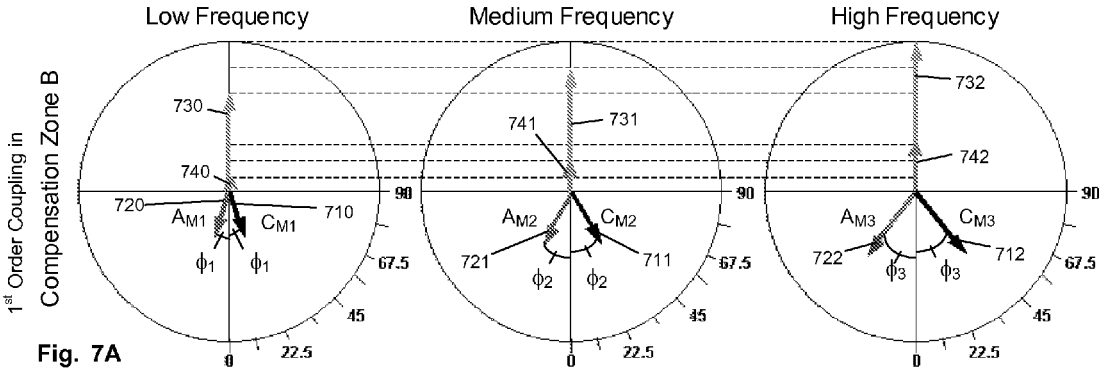
FIGS. 7A and 7B illustrate a simplified vector model of an RJ45 plug and jack three-zone system at various frequencies when a first-order coupling and a lattice network, respectively, are used in the compensation zone.
Figure 7B:
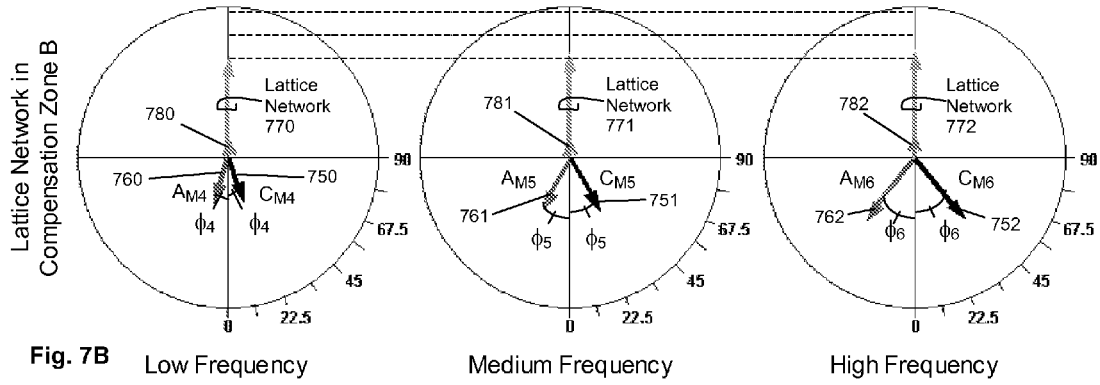

Implementation of a first-order coupling in the compensation zone in FIG. 7A is compared to implementation of a lattice network in the compensation zone in FIG. 7B. The vector diagrams of FIGS. 7A and 7B assume that the plug/jack system is balanced, i.e. the phase angle differences between the compensation and the crosstalk from the contact zone and between the compensation and the crosstalk from the crosstalk zone are the same and that the crosstalk in the contact zone has the same magnitude as the crosstalk in the crosstalk zone. The crosstalk components are shown in FIGS. 7A and 7B by the vectors pointing downward (710, 711, 712, 720, 721, 722 in FIGS. 7A and 750, 751, 752, 760, 761, 762 in FIG. 7B). The crosstalk vectors are symmetric around 0° (the compensation zone is taken as the reference plane in FIGS. 7 and 8) as shown by angles $\phi_1$, $\phi_2$, $\phi_3$ in FIG. 7A and $\phi_4$, $\phi_5$, $\phi_6$ in FIG. 7B. The angles represent the phase difference between the compensation zone and the contact and crosstalk zones. The relative magnitude of the crosstalk vector 720, 721, 722 in the contact zone is $A_{m1}$, $A_{m2}$, $A_{m3}$, respectively, and the relative magnitude of the crosstalk vector 710, 711, 712 in the crosstalk zone is $C_{m1}$, $C_{m2}$, $C_{m3}$, respectively, in FIG. 7A. Similarly, the relative magnitude of the crosstalk vector in the contact zone 760, 761, 762 is $A_{m4}$, $A_{m5}$, $A_{m6}$, respectively, and the relative magnitude of the crosstalk vector 750, 751, 752 in the crosstalk zone is $C_{m4}$, $C_{m5}$, $C_{m6}$, respectively, in FIG. 7B. The crosstalk vectors increase in relative magnitude and angle with frequency. Thus, $\phi_1<\phi_2<\phi_3$ and $(A_{m1}=C_{m1})<(A_{m2}=C_{m2})<(A_{m3}=C_{m3})$ in FIG. 7A and $\phi_4<\phi_5<\phi_6$ and $(A_{m4}=C_{m4})<(A_{m5}=C_{m5})<(A_{m6}=C_{m6})$ in FIG. 7B.

The compensation in the compensation zone is provided to compensate for the crosstalk in the plug/jack system. The compensation vector (730, 731, 732 in FIGS. 7A and 770, 771, 772 in FIG. 7B) from the compensation zone has a polarity opposite to that of the resultant of the crosstalk vectors. The resultant vector (740, 741, 742 in FIGS. 7A and 780, 781, 782 in FIG. 7B) is the combination of the crosstalk and compensation vectors. Thus, the resultant vector represents the crosstalk remaining in the plug/jack system after compensation. The angles of each pair of crosstalk vectors (710 and 720, 711 and 721, 712 and 722 in FIG. 7A, and 750 and 760, 751 and 761, 752 and 762 in FIG. 7B) from the reference plane are the same at a particular frequency over the range of frequencies shown in FIGS. 7A and 7B. The sine $\phi$ components (i.e., the horizontal components in FIGS. 7A and 7B) of the crosstalk vectors from the crosstalk and contact zones at each frequency, i.e., 710 and 720, 711 and 721, 712 and 722, 750 and 760, 751 and 761, 752 and 762 cancel each other, leaving only the cosine $\phi$ components (i.e., the vertical components in FIGS. 7A and 7B). Thus, the resultant vector overlies the compensation vector (i.e., 740 overlies 730, 741 overlies 731, 742 overlies 732 in FIG. 7A, 780 overlies 770, 781 overlies 771, 782 overlies 772 in FIG. 7B). In FIG. 7A, the magnitudes of the compensation and the crosstalk vectors individually increase with frequency at a rate of about 20 dB per decade. This causes the resultant vector to increase relatively rapidly with frequency because the compensation vector increases more than the combined cosine $\phi$ components of the crosstalk vectors from the crosstalk and contact zones. Thus, without the use of the lattice network, the crosstalk in the plug/jack system increases substantially with increasing frequency.

The vector diagrams of FIG. 7B illustrate a plug/jack system that employs a lattice network in the compensation zone. The vectors in FIG. 7B are similar to those in FIG. 7A. However, in the plug/jack system shown in FIG. 7B, the compensation vector 770, 771, 772 increases with frequency at a rate of less than 20 dB per decade, i.e. less than that of the individual crosstalk vectors 750, 751, 760, 761, 752, 762. The increase of the compensation vector 770, 771, 772 can be better matched to the increase in the combined cosine $\phi$ components of the respective crosstalk vectors 750 and 760, 751 and 761, 752 and 762. The resultant vector still has no phase shift but increases with frequency less than in the jack of FIG. 7A.

A simplified vector model of an RJ45 plug and jack three-zone system at different frequencies in which a first-order coupling is implemented in the crosstalk zone is shown in FIG. 8A, and a vector model in which a lattice network is implemented in the crosstalk zone is shown in FIG. 8B. Unlike the vector diagrams of FIGS. 7A and 7B, the vector diagrams of FIGS. 8A and 8B assume that the plug/jack system is not balanced. The phase angle differences between the compensation and the crosstalk from the contact zone and between the compensation and the crosstalk from the crosstalk zone are not the same. As illustrated by the angles ($\theta$) in FIG. 8A, the phase shift of the crosstalk zone crosstalk from the compensation is smaller than the phase shift of the contact zone crosstalk from the compensation (i.e., $\theta_1>\theta_2$, $\theta_3>\theta_4$, $\theta_5>\theta_6$). Nor do the crosstalk in the contact zone and the crosstalk in the crosstalk zone in FIG. 8A have the same magnitude; the magnitude of crosstalk in the contact zone is larger than the magnitude of the crosstalk in the crosstalk zone (i.e., $A_{n1}>C_{n1}$, $A_{n2}>C_{n2}$, $A_{n3}>C_{n3}$).

In FIG. 8A, similarly to FIG. 7A, the magnitudes of the individual crosstalk vectors 810, 811, 812, 820, 821, 822 increase with frequency at a rate of about 20 dB per decade (i.e., $A_{n3}>A_{n2}>A_{n1}$ and $C_{n3}>C_{n2}>C_{n1}$). The magnitude of the compensation vector 830, 831, 832 also correspondingly increases with frequency at a rate of about 20 dB per decade. Due to the imbalance, the resultant vector 840, 841, 842 does not overlie the compensation vector 830, 831, 832. Thus, the resultant vector 840, 841, 842 grows in magnitude and phase delay with increasing frequency due to the increased phase mismatch of the crosstalk vectors 810 and 820, 811 and 821, 812 and 822.

Employing a lattice network in the crosstalk zone reduces the relative magnitude of the resultant vector, as shown in FIG. 8B. Unlike FIG. 8A, the plug/jack system in FIG. 8B is effectively balanced, that is, the crosstalk vector 860, 861, 862 introduced in the contact zone and the crosstalk vector 850, 851, 852 introduced in the crosstalk zone have the same relative magnitude (i.e., $A_{n4}=C_{n4}$, $A_{n5}=C_{n5}$, $A_{n6}=C_{n6}$) and phase difference with respect to the compensation zone. As the frequency increases, the relative magnitude of the crosstalk vector 850, 851, 852 in the crosstalk zone due to the lattice network as shown in FIG. 8B increases at a greater rate than the relative magnitude of the crosstalk vector 810, 811, 812 in the crosstalk zone due to a first-order coupling as shown in FIG. 8A. The relative magnitude of the resultant vector 880, 881, 882 in the plug/jack system implementing the lattice network in the crosstalk zone thus increases with frequency less than in a plug/jack system implementing a first-order coupling in the crosstalk zone.

Figure 9:
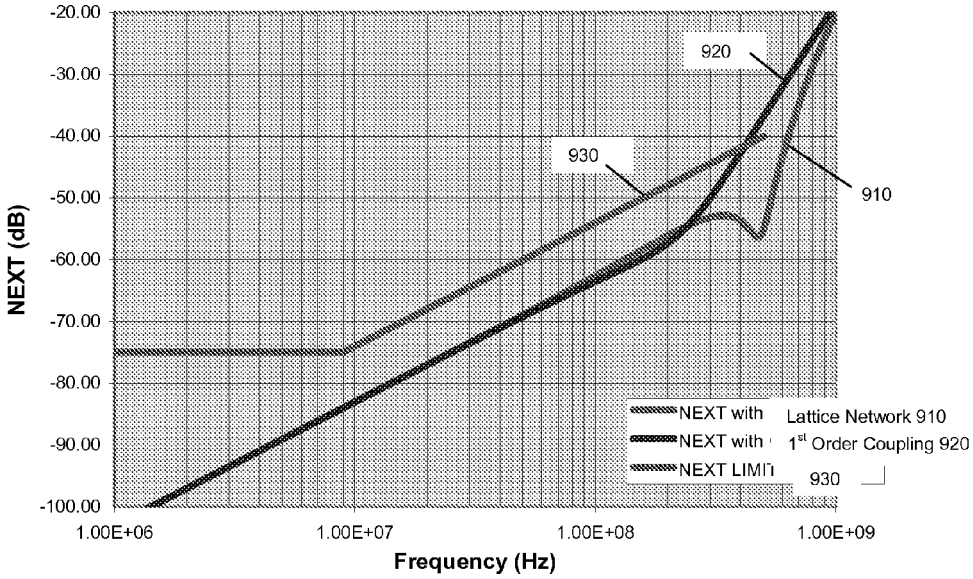
FIG. 9 is a simulation of the near end crosstalk in a plug/jack system comparing a first-order coupling and a lattice network in the crosstalk zone.

SPICE simulations of a first-order coupling and a lattice network implemented in the crosstalk zone are compared to the NEXT limit (ANSI/TIA/EIA-568B.2-1 standard) in FIG. 9. In the simulation, below about 100 MHz, the NEXT of the plug/jack system having a lattice network in the crosstalk zone 910 and the NEXT of the plug/jack system having first-order coupling in the crosstalk zone 920 are almost identical. Between about 100 MHz and 220 MHz, the NEXT of the plug/jack system having a lattice network in the crosstalk zone 910 is slightly larger than the NEXT of the plug/jack system having first-order coupling in the crosstalk zone 920. Between about 250 MHz and 1 GHz, the NEXT of the plug/jack system having a lattice network in the crosstalk zone 910 is significantly less than the NEXT of the plug/jack system having first-order coupling in the crosstalk zone 920. In particular, the difference between the NEXT of the plug/jack system with the lattice network 910 and the NEXT of the plug/jack system with the first-order coupling 920 increases to 15-20 dB at about 500 MHz. The NEXT of the plug/jack system with both the lattice network 910 and the first-order coupling 920 are below the NEXT limit 930 for frequencies less than about 400 MHz. Above 400 MHz, the NEXT of the plug/jack system with the first-order coupling 920 exceeds the NEXT limit 930 while the NEXT of the plug/jack system with the lattice network 910 remains below the NEXT limit 930. Both the bandwidth of an RJ45 jack and the NEXT margin (the difference between the NEXT in the plug/jack system and the NEXT limit) are improved over a first-order coupling by using a lattice network in the crosstalk zone in the normal operating range of the plug/jack system.

Figure 10:
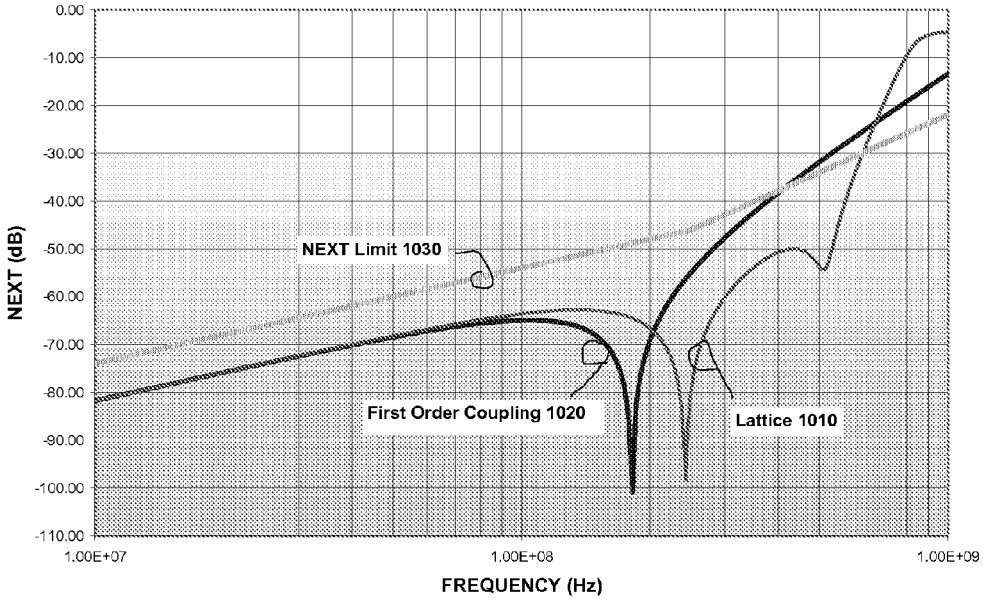
FIG. 10 is a simulation of the near end crosstalk in a plug/jack system comparing a first-order coupling and a lattice network in the compensation zone.

SPICE simulations of a first-order coupling and a lattice network implemented in the compensation zone are compared to the NEXT limit in FIG. 10. As in the simulation of FIG. 9, the NEXT of the plug/jack system having a lattice network in the compensation zone 1010 and the NEXT of the plug/jack system having first-order coupling in the compensation zone 1020 are almost identical below about 100 MHz. Between about 100 MHz and 200 MHz, the NEXT of the plug/jack system having a lattice network in the compensation zone 1010 is larger than the NEXT of the plug/jack system having first-order coupling in the compensation zone 1020. Between about 200 MHz and 600 MHz, the NEXT of the plug/jack system having a lattice network in the compensation zone 1010 is significantly less than the NEXT of the plug/jack system having first-order coupling in the compensation zone 1020. In particular, the difference between the NEXT of the plug/jack system with the lattice network 1010 and the NEXT of the plug/jack system with the first-order coupling 1020 increases to 23-24 dB at about 500 MHz. The NEXT of the plug/jack system with both the lattice network 1010 and the first-order coupling 1020 are below the NEXT limit 1030 for frequencies less than about 400 MHz. Above 400 MHz, the NEXT of the plug/jack system with the first-order coupling 1020 exceeds the NEXT limit 1030 while the NEXT of the plug/jack system with the lattice network 1010 remains below the NEXT limit 1030. As above, both the bandwidth of an RJ45 jack and the NEXT margin (the difference between the NEXT in the plug/jack system and the NEXT limit) are improved over a first-order coupling by using a lattice network in the compensation zone in the normal operating range of the plug/jack system.

Figure 11A:
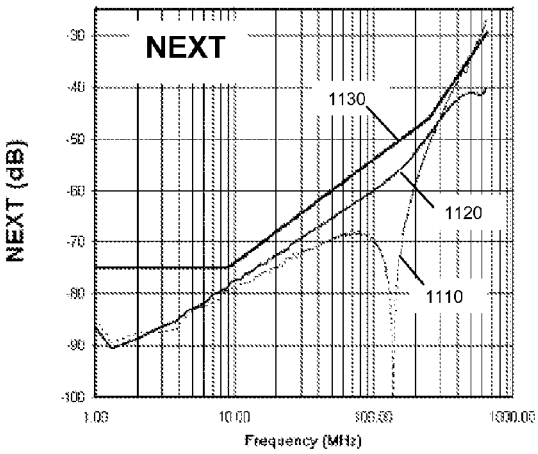
FIGS. 11A and 11B show near end crosstalk (FIG. 11A) and far end crosstalk (FIG. 11B) for a 10 GbE RJ45 jack having a lattice network in the crosstalk zone.
Figure 11B:
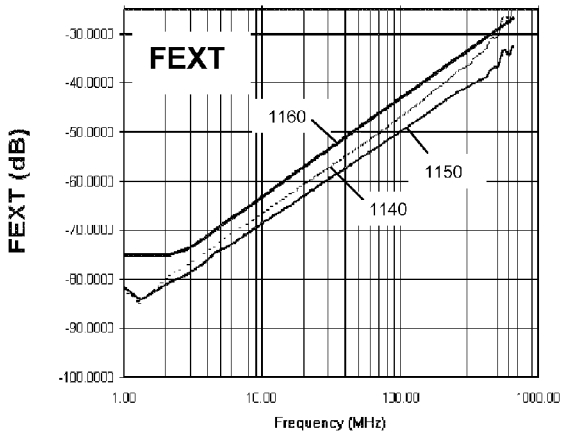

FIGS. 11A and 11B show near-end crosstalk (NEXT) and far-end crosstalk (FEXT) measurements, respectively, of plug/jack systems having first-order coupling in the crosstalk zone and of plug/jack systems employing a lattice network in the crosstalk zone. In both cases, an RJ45 plug having the performance level of a "middle plug" specification as defined by TIA568b is used. As shown in FIG. 11A, the NEXT performance of the jack using a lattice network 1120 is better than the NEXT performance of the jack using first-order coupling 1110 at frequencies exceeding about 300 MHz. The NEXT performances of the jack having a lattice network 1120 and having a first-order coupling 1110 are below the 10G NEXT requirement 1130 for frequencies below about 400 MHz, while only the NEXT performance of the jack having a lattice network 1120 is below the 10G NEXT requirement 1130 for frequencies above about 400 MHz. In FIG. 11B, while the FEXT performances of the jack having a lattice network 1150 and having a first-order coupling 1140 are below the 10G FEXT requirement 1160 (ANSI/TIA/EIA-568B.2-1 standard) for frequencies below about 500 MHz, the FEXT performance of the jack having a lattice network 1150 is better than that of the jack having a first-order coupling 1140 over all frequencies above 2 MHz.

Other network configurations may be used in addition to those illustrated above. For example, an inductor such as a self-inductance element may be used as a crosstalk circuit component (e.g. between conductors 3 and 4 and between 5 and 6) in the lattice network. FIGS. 12-21 illustrate other networks that may be used.

Figure 12B:
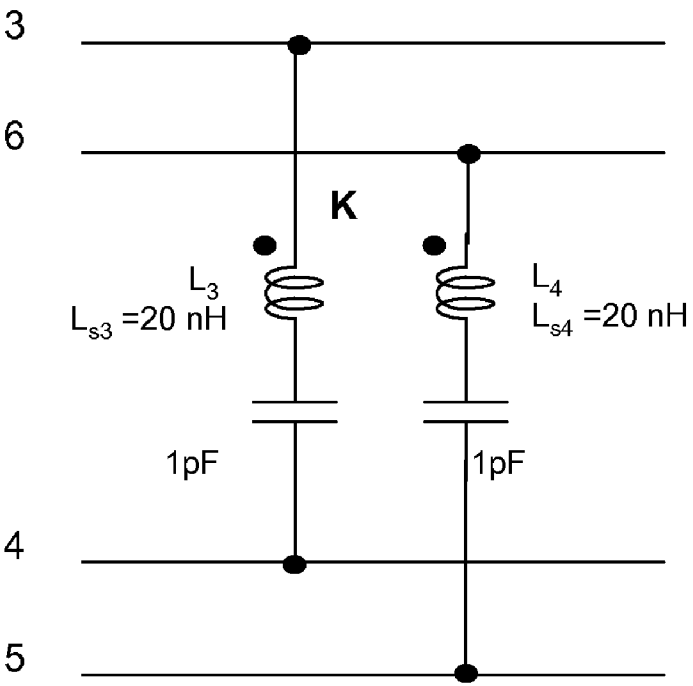
FIGS. 12A-12F show positive and negative mutual inductance between pairs of conductors and a simulation of the coupling vs. frequency for each configuration.
Figure 12A:
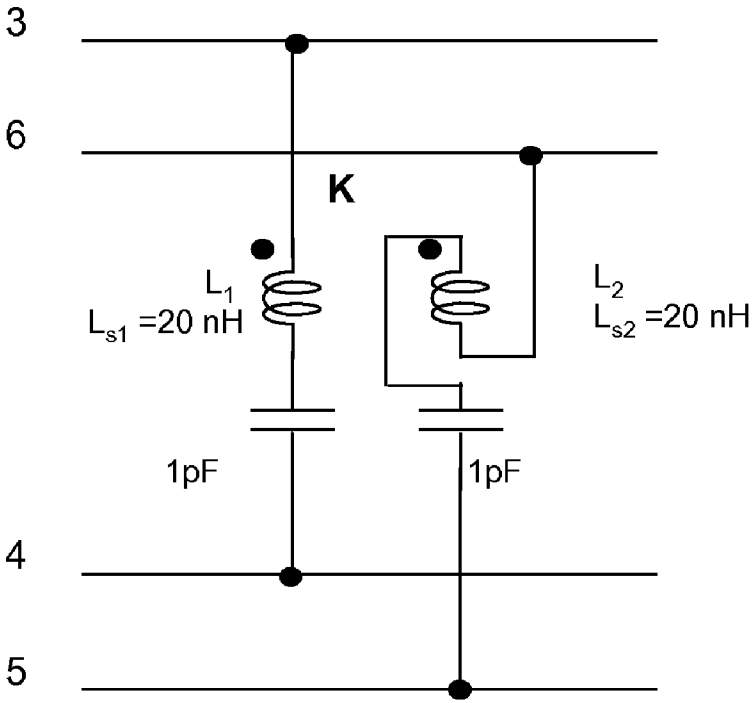

FIGS. 12A and 12B show the use of negative and positive mutual inductance in a coupling between each pair of conductors. The only difference between these figures is that the connection of $L_2$ is reversed, so that FIG. 12A has a negative mutual inductance and FIG. 12B has a positive mutual inductance. In these figures, the coupling between each pair of conductors includes a capacitor in series with an inductor. The mutual inductance, M, of the inductor varies with a mutual coupling constant, K. K varies between 0 and 1 (i.e., $0 \leqq K \leqq 1$). Each capacitor is 1 pF and the self-inductance $L_s$ of each inductor $L_{s1}$, $L_{s2}$, $L_{s3}$, $L_{s4}$ is 20 nH in FIGS. 12A and 12B. The inductance of each inductor in FIG. 12A varies such that $L_1=L_{s1}+M=L_s+M$ and $L_2=L_{s2}+M=L_s+M$, where $M=-K*\sqrt{L_{s1}*L_{s2}}=-K*L_s$, so that $L_1=L_2=(1-K)*L_s$. Thus, when K=0, M=0, and $L_1=L_2=20$ nH. As K approaches 1, M approaches $-L_s$, and the net inductance of each inductor ($L_s+M$) goes to 0. Thus, as K approaches 1, the response of the series LC circuit between each pair of conductors approaches that of an ideal capacitive coupling only. Similarly, the inductor in FIG. 12B varies such that $M=K*L_s$ and $L_3=L_4=(1+K)*L_s$. Thus, as K approaches 1, M approaches $L_s$, and $L_3=L_4=2L_s$.

Figure 12C:
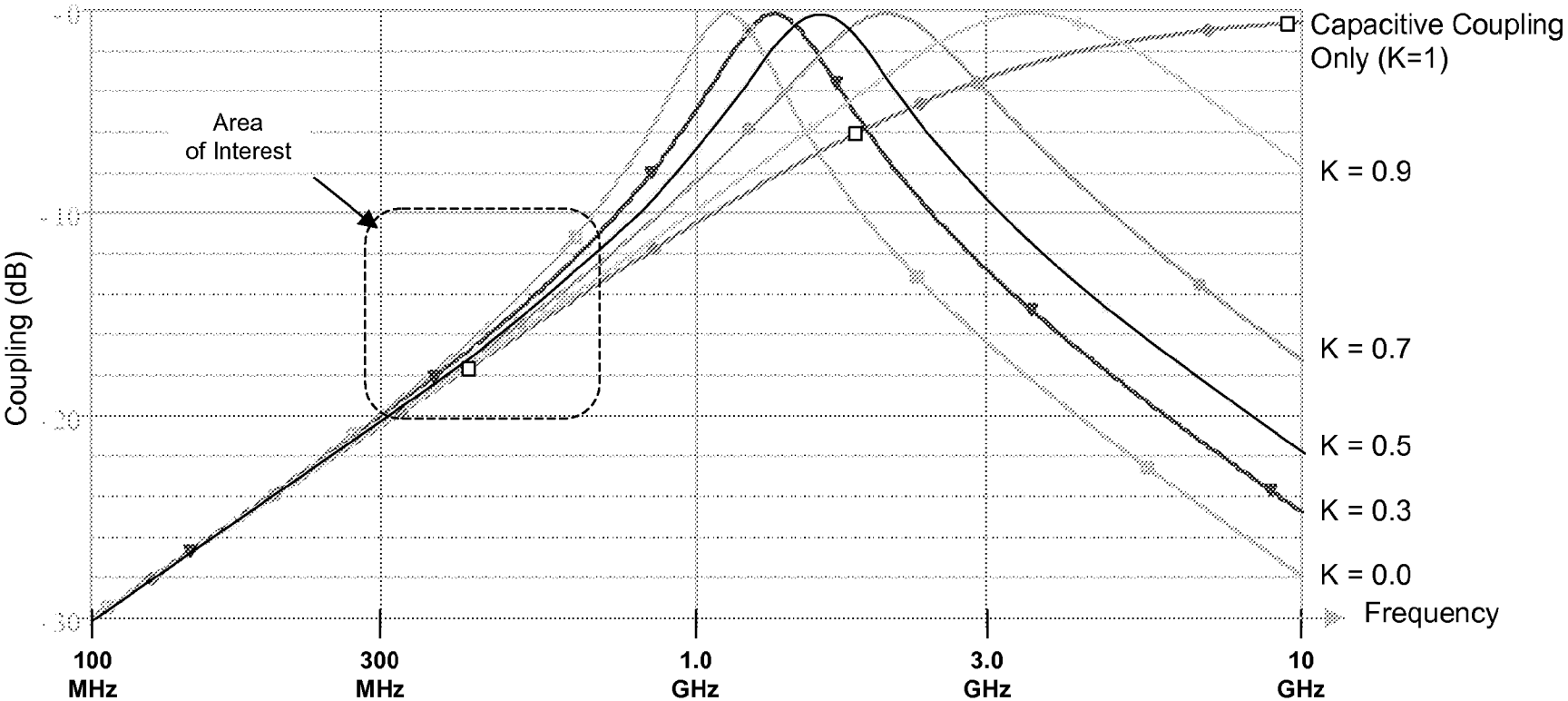
Figure 12D:
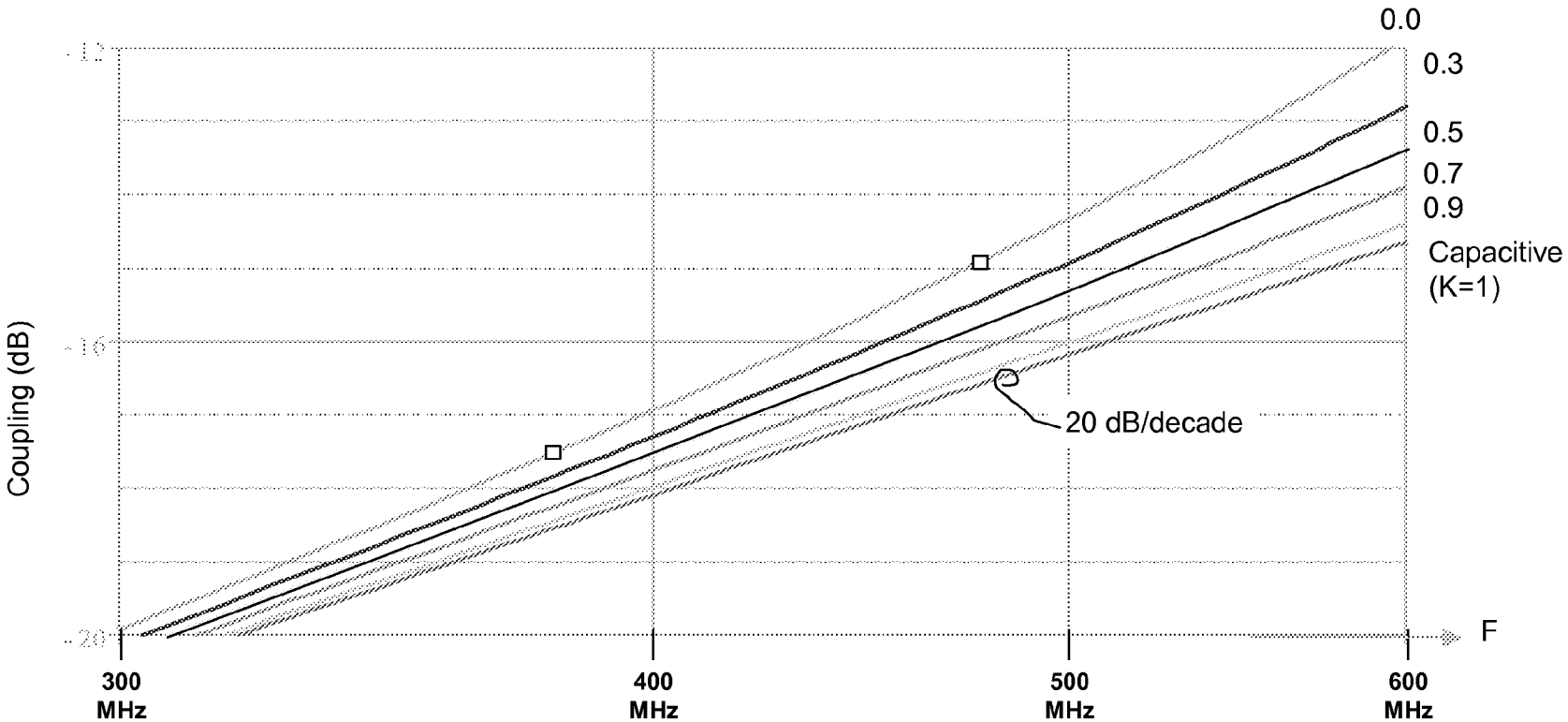
Figure 12E:
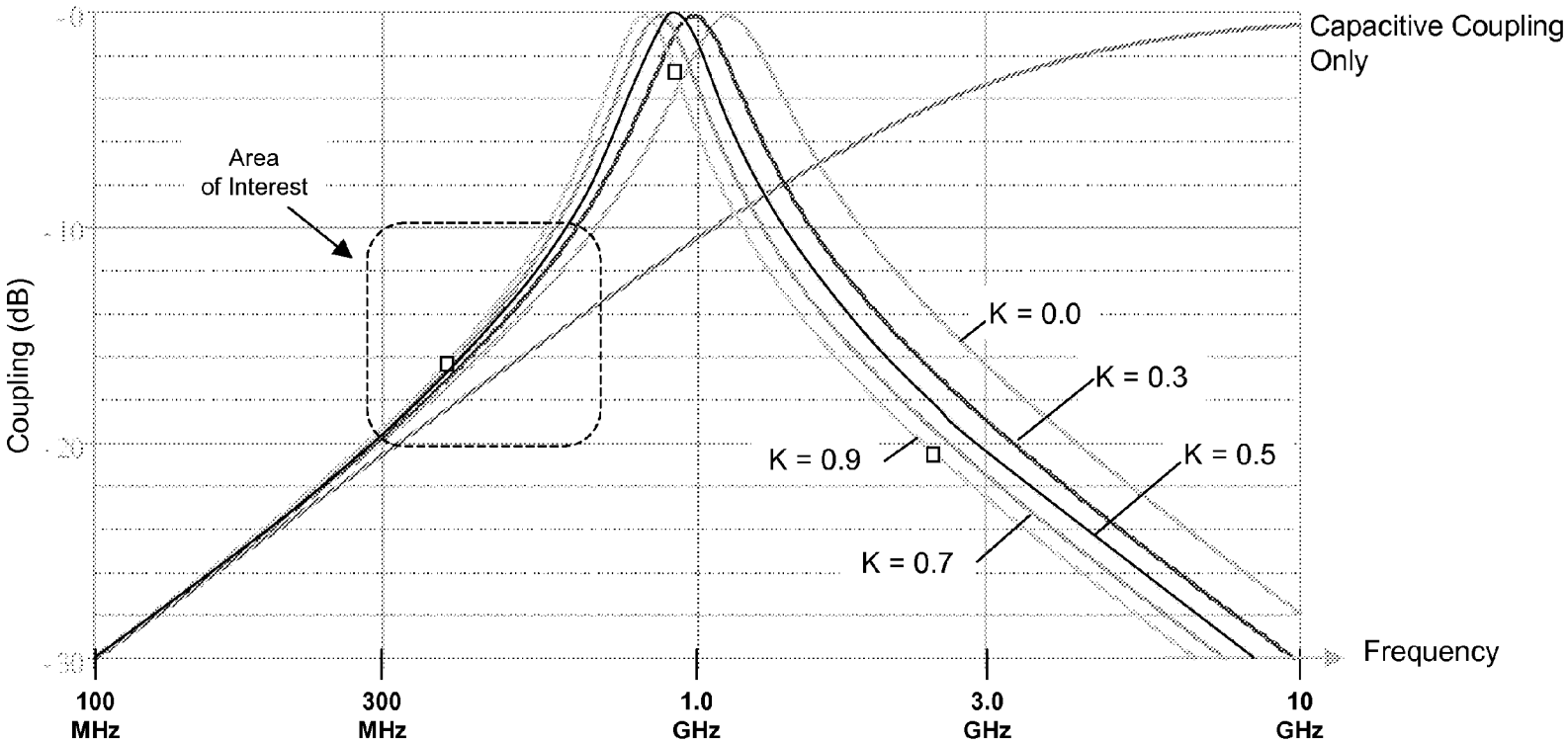
Figure 12F:
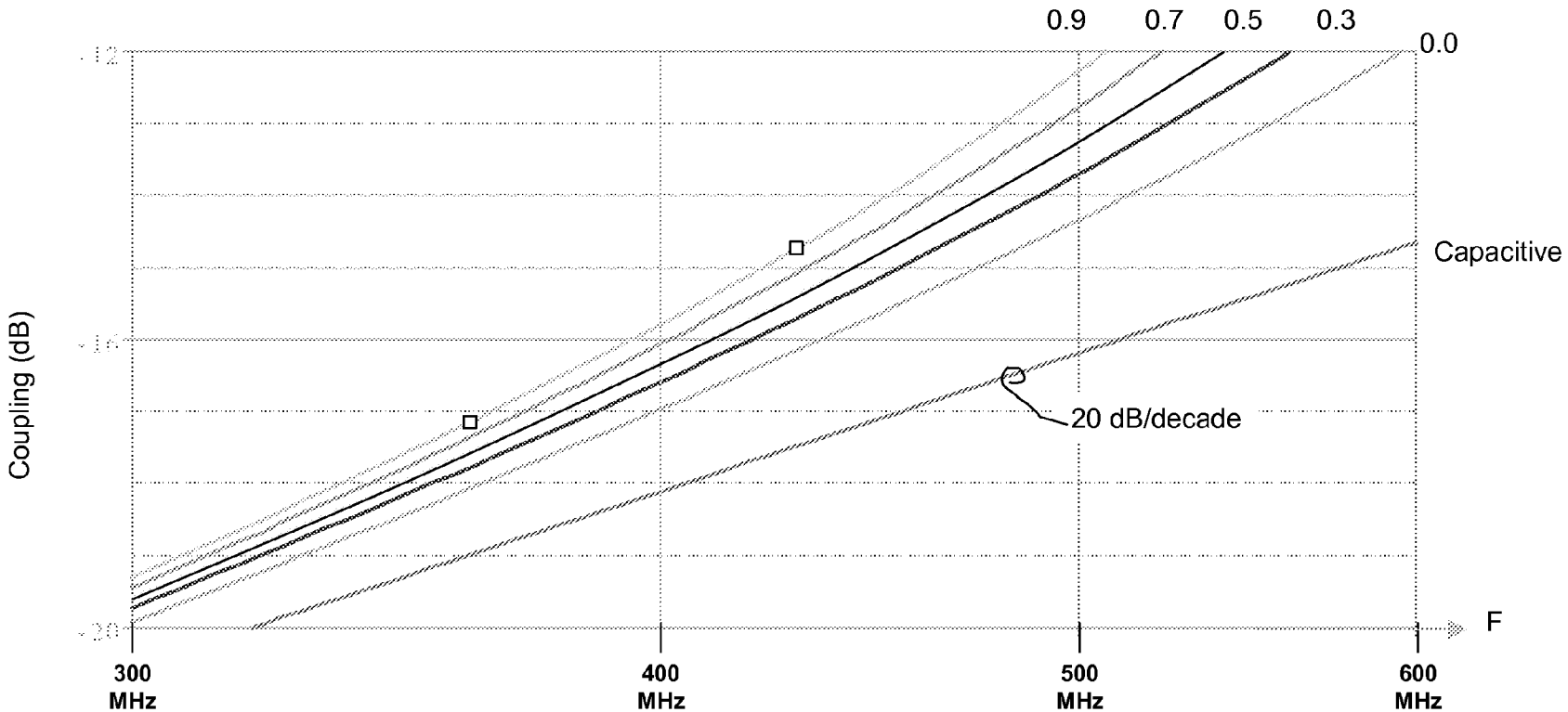

FIGS. 12C-12F are simulations of couplings using the circuits shown in FIGS. 12A and 12B. More specifically, FIG. 12C is a simulation of the configuration of FIG. 12A, while FIG. 12D is an enhancement of FIG. 12C in the area of interest between about 200 MHz and 500 MHz. Similarly, FIG. 12E is a simulation of the configuration of FIG. 12B, while FIG. 12F is an enhancement of FIG. 12E in the area of interest. As illustrated in FIGS. 12C and 12D, the coupling decreases at all frequencies within the area of interest as the amount of negative mutual inductance increases. As illustrated in FIGS. 12E and 12F, the coupling increases at all frequencies within the area of interest as the amount of positive mutual inductance increases.

Figure 13B:
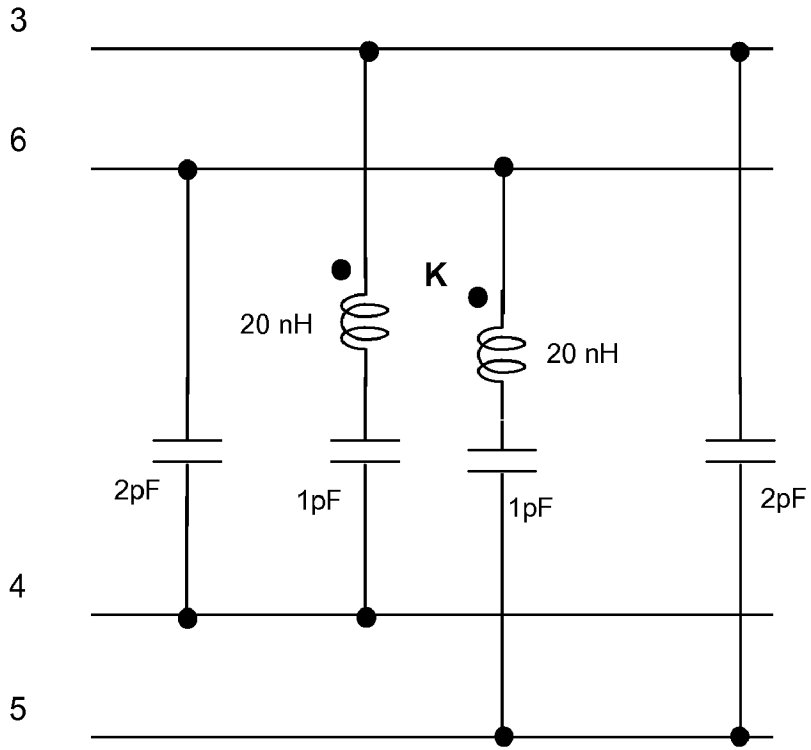
FIGS. 13A and 13B show two embodiments using positive and negative mutual inductance in a lattice network.
Figure 13A:
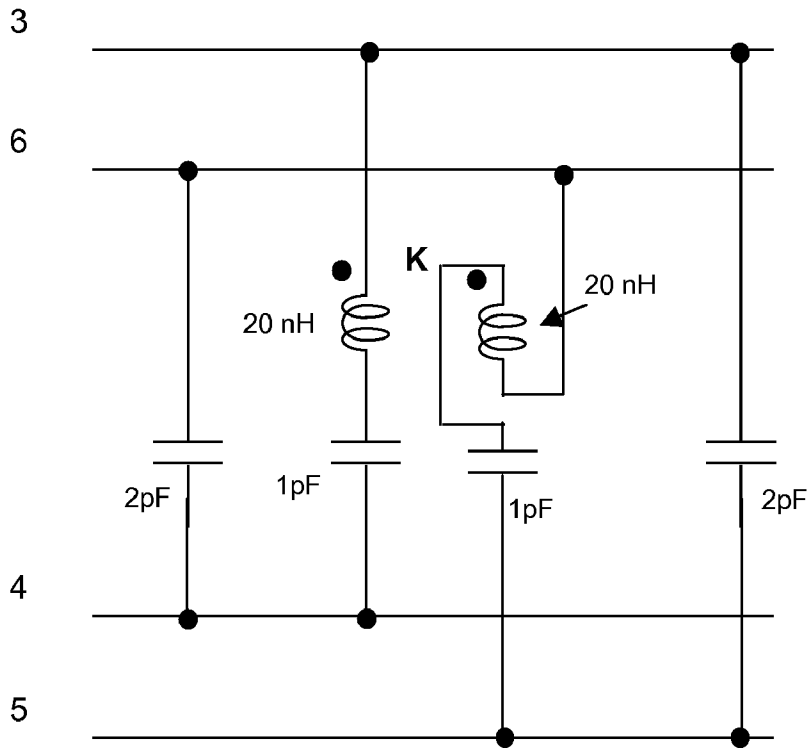
Figure 13C:
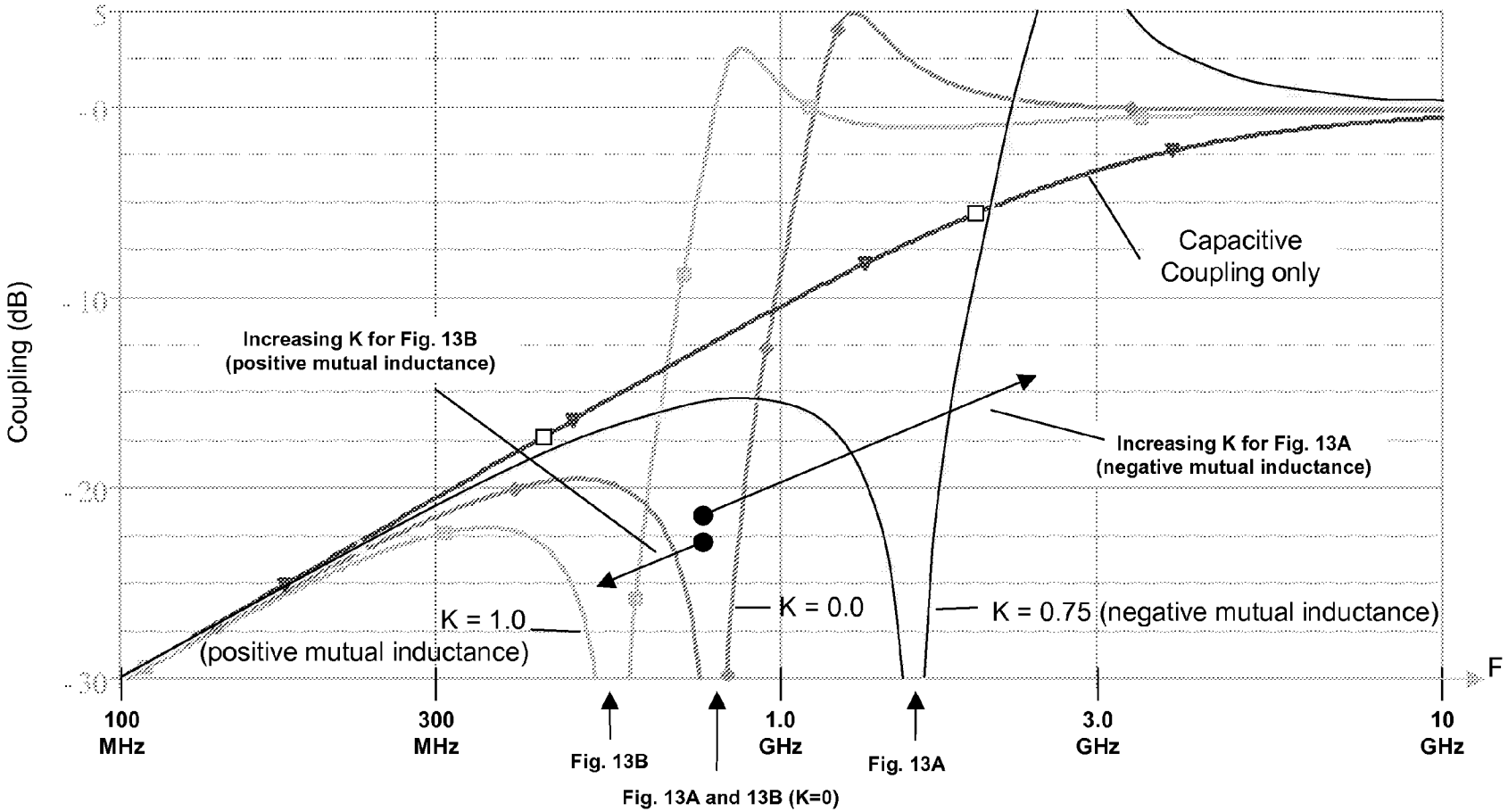
FIG. 13C is a simulation of the lattice network coupling vs. frequency for each configuration in FIGS. 13A and 13B.

FIGS. 13A and 13B show the use of negative and positive mutual inductance in a lattice network. The lattice network of FIG. 13A has a negative mutual inductance and the lattice network of FIG. 13B has a positive mutual inductance. As in the series LC circuit of FIGS. 12A and 12B, the self inductance of each inductor in the series LC circuit of the lattice network is 20 nH. The capacitance in each series LC circuit is 1 pF, and each shunt capacitor has a capacitance of 2 pF. FIG. 13C is a simulation showing the coupling in a lattice network using either negative mutual inductance (FIG. 13A) or positive mutual inductance (FIG. 13B). As shown in FIG. 13C, using positive mutual inductance decreases the amount of coupling in the frequency range of 200-500 MHz to a greater extent than using negative mutual inductance.

Figure 14B:
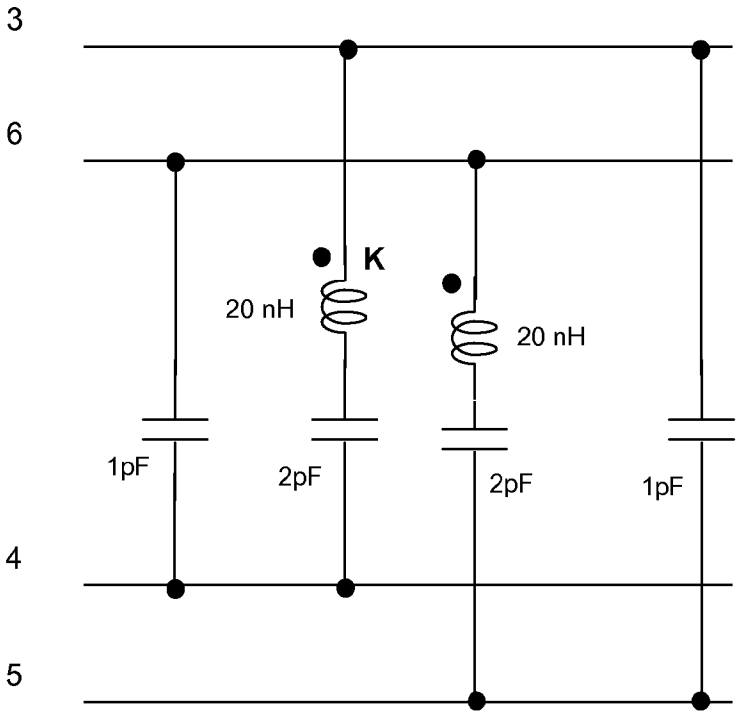
FIGS. 14A and 14B show other embodiments using positive and negative mutual inductance in a lattice network.
Figure 14A:
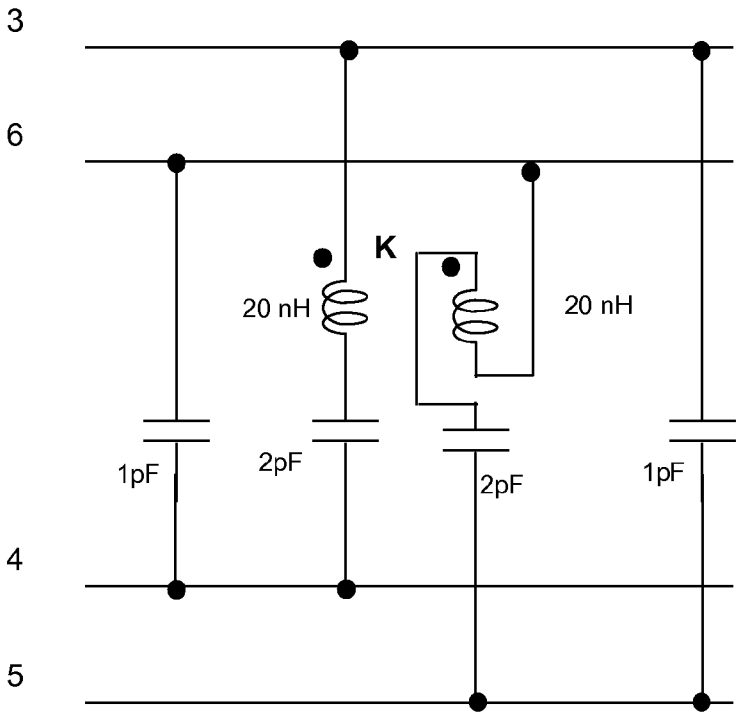
Figure 14C:
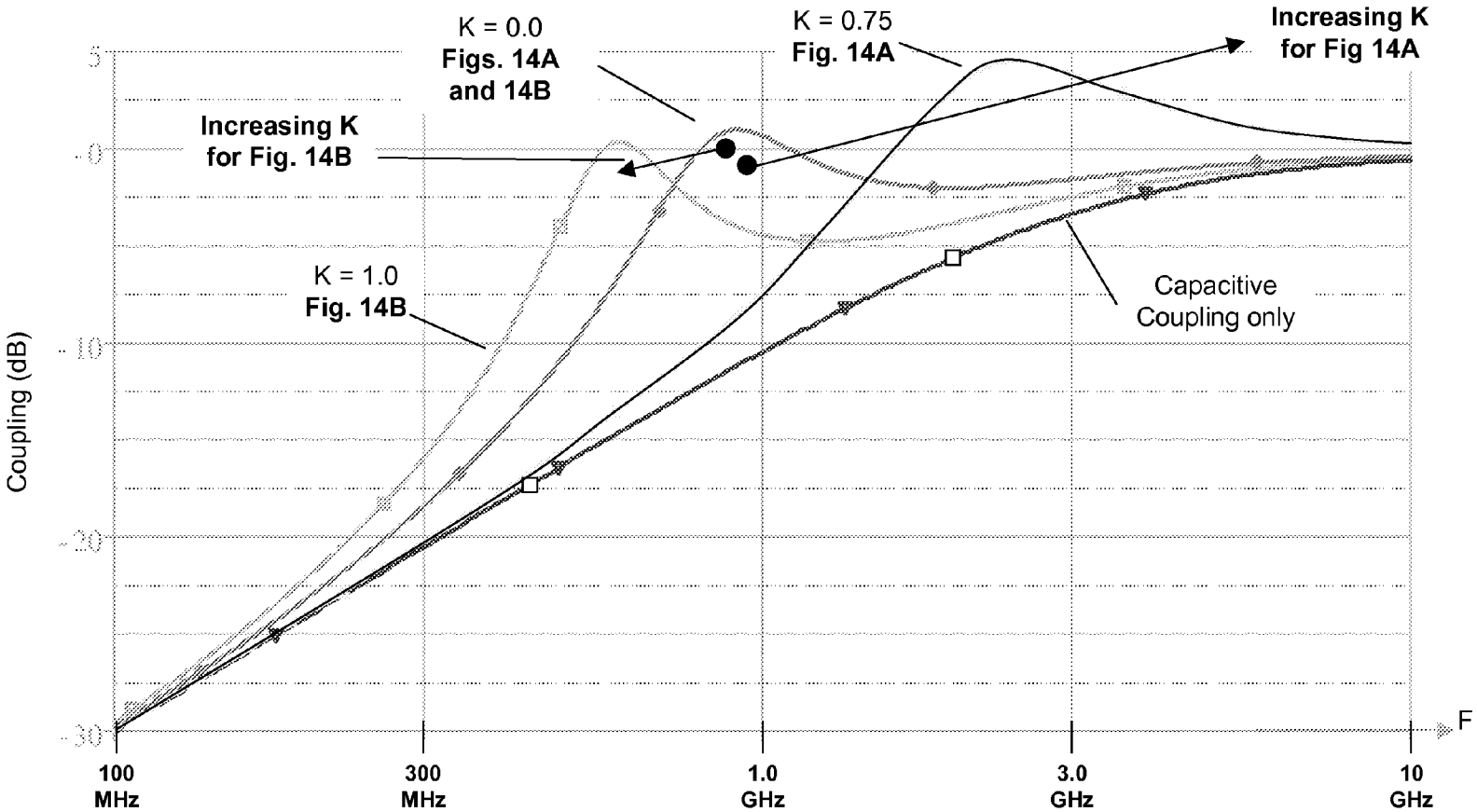
FIG. 14C is a simulation of the lattice network coupling vs. frequency for each configuration in FIGS. 14A and 14B compared to a capacitive coupling.
Figure 15:
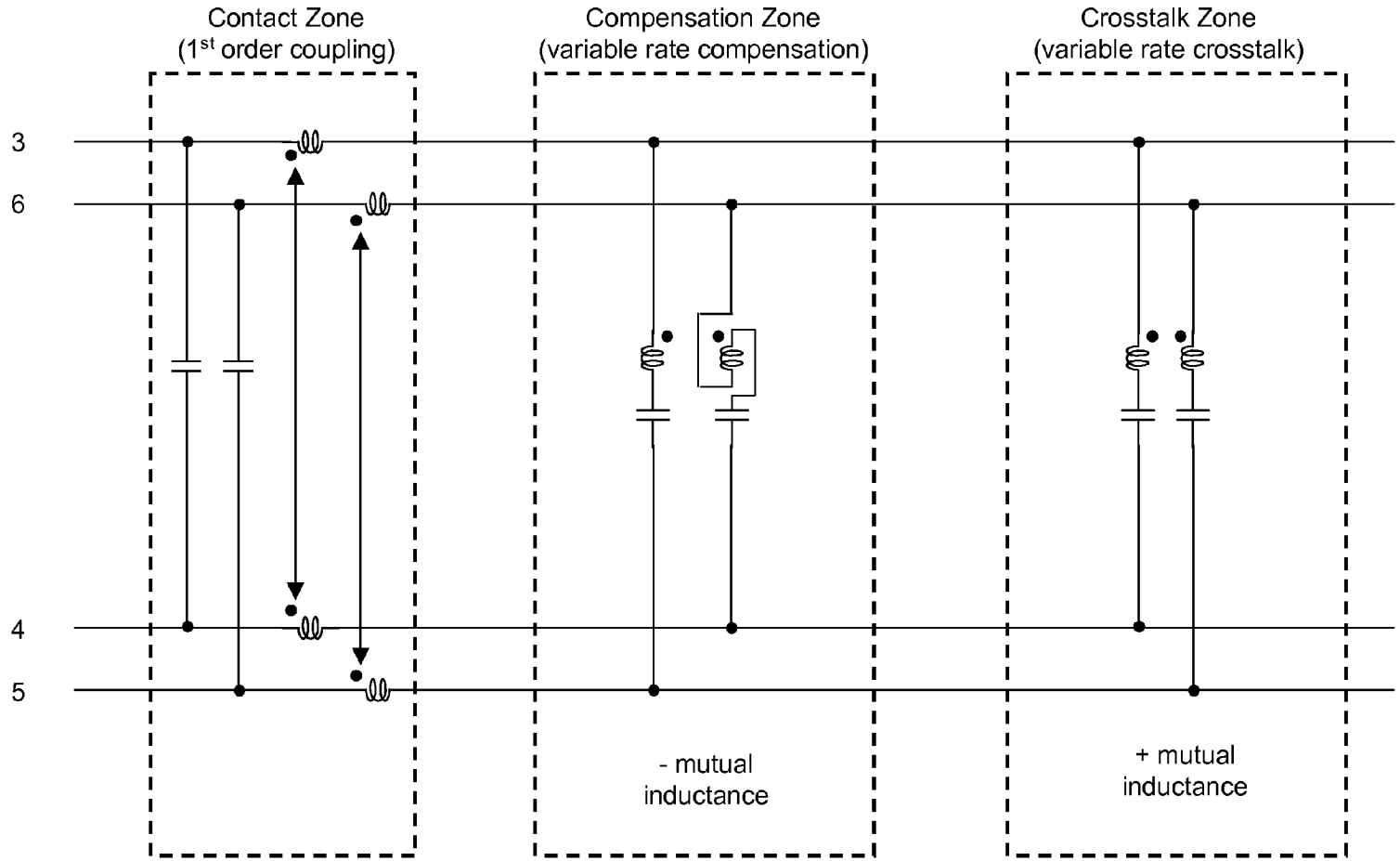
FIG. 15 shows a jack containing a series LC circuit with negative mutual inductance in the compensation zone and with positive mutual inductance in the crosstalk zone.
Figure 16:
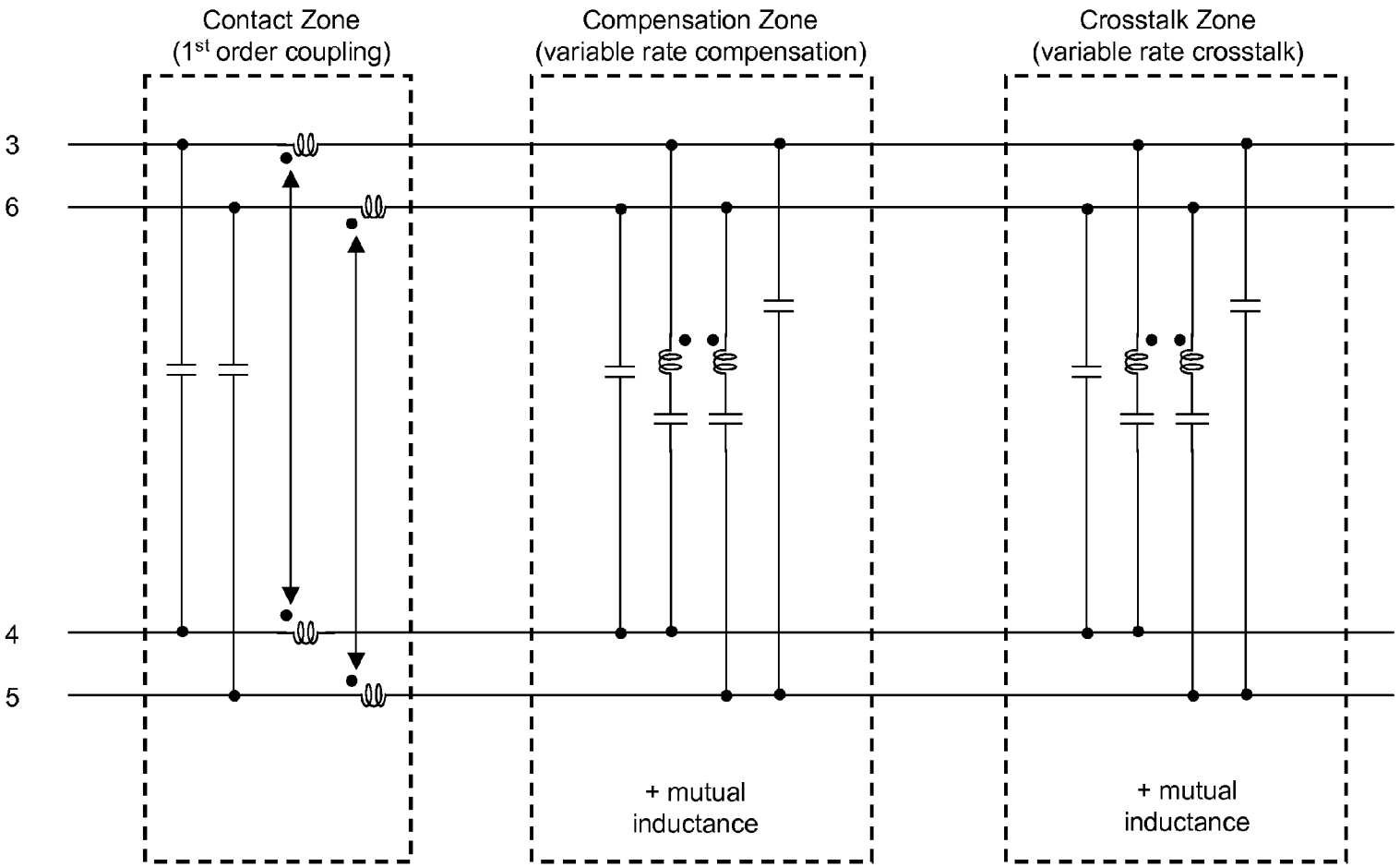
FIGS. 16-19 show various jack configurations with lattice networks containing negative or positive mutual inductance in the compensation and crosstalk zones.
Figure 17:
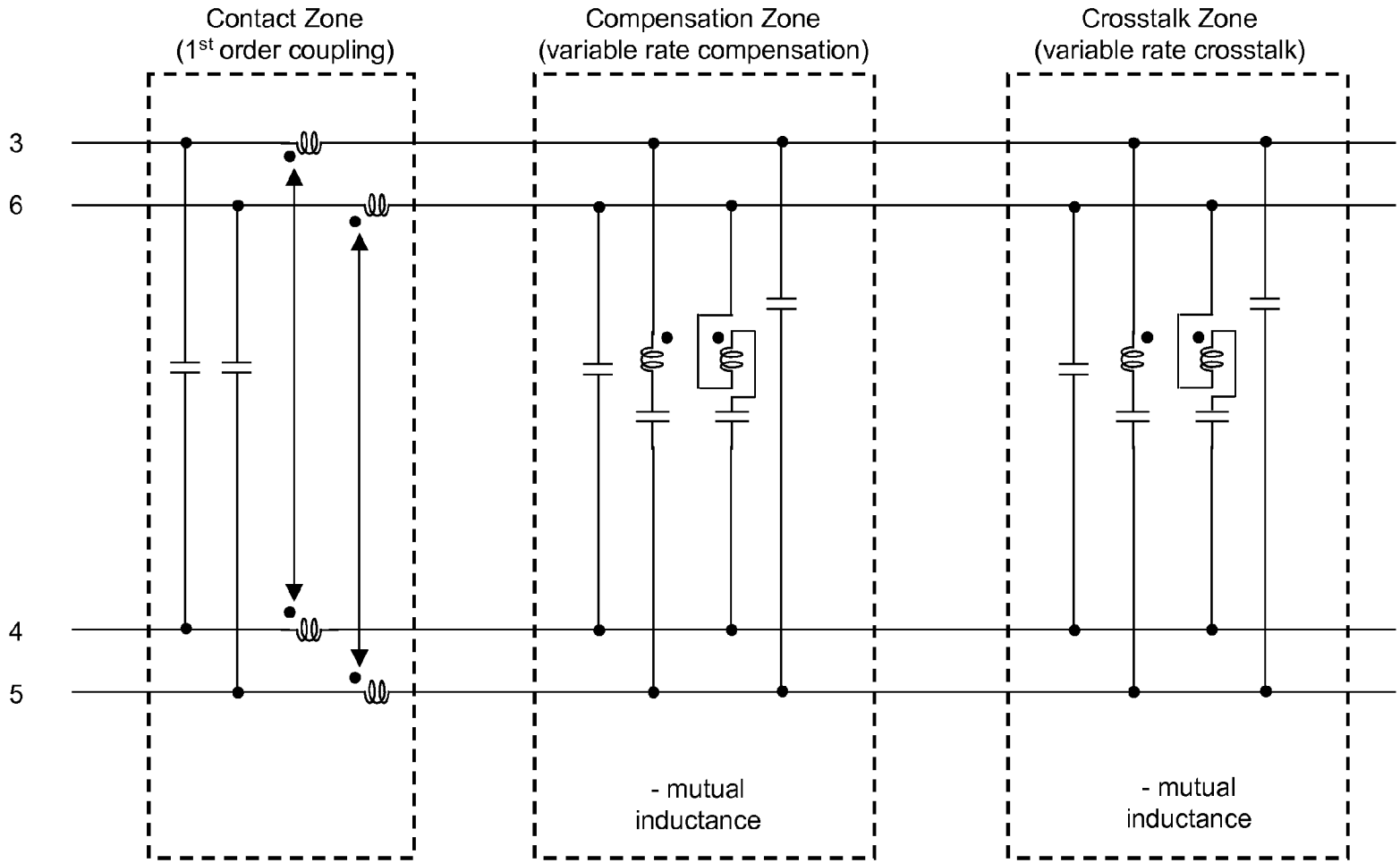
Figure 18:
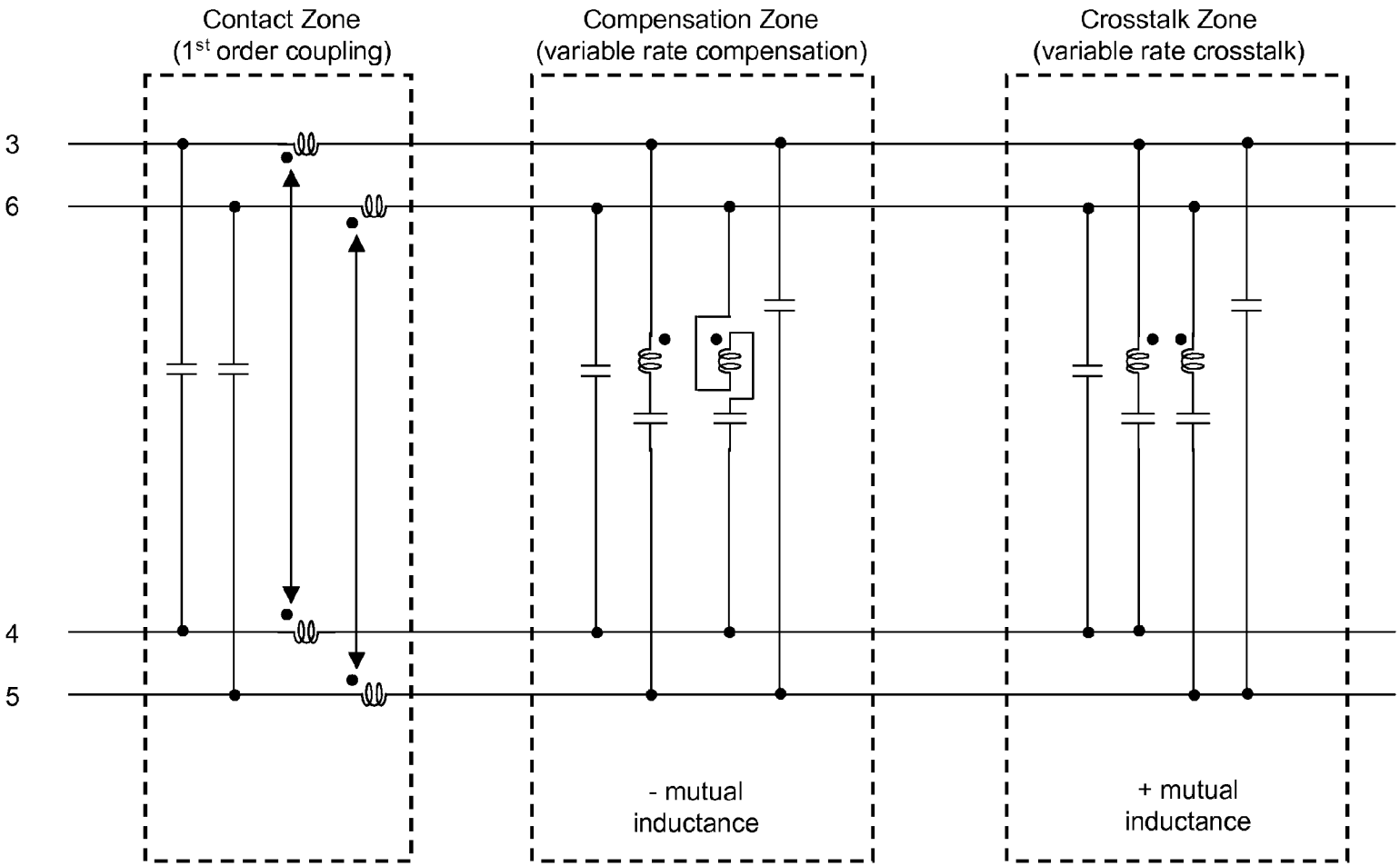
Figure 19:
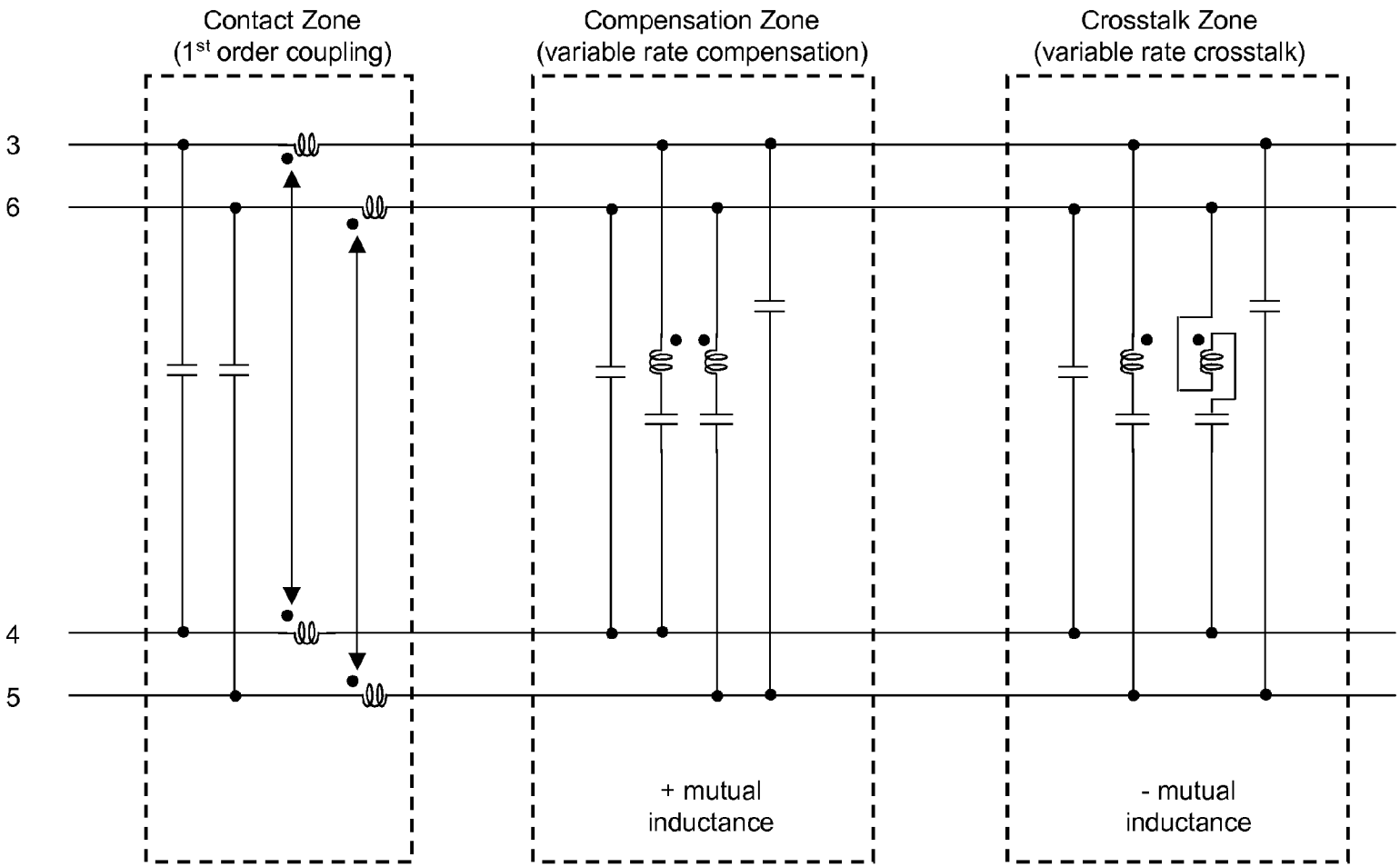

FIGS. 14A and 14B show a lattice network having negative and positive mutual inductance, respectively. As in the series LC circuit of FIGS. 13A and 13B, the self inductance of each inductor in the series LC circuit of the lattice network is 20 nH. Unlike the configurations of FIGS. 13A and 13B however, the capacitance in each series LC circuit is 2 pF, and each shunt capacitor has a capacitance of 1 pF. FIG. 14C is a simulation showing the coupling in a lattice network using either negative mutual inductance (FIG. 14A) or positive mutual inductance (FIG. 14B). As shown in FIG. 14C, using positive mutual inductance increases the amount of coupling in the frequency range of 200-500 MHz to a greater extent than using negative mutual inductance. The difference in the amount of coupling between FIGS. 13 and 14 is a result of the relative differences between the series LC circuit capacitance and the shunt capacitance between the figures.

Figure 20:
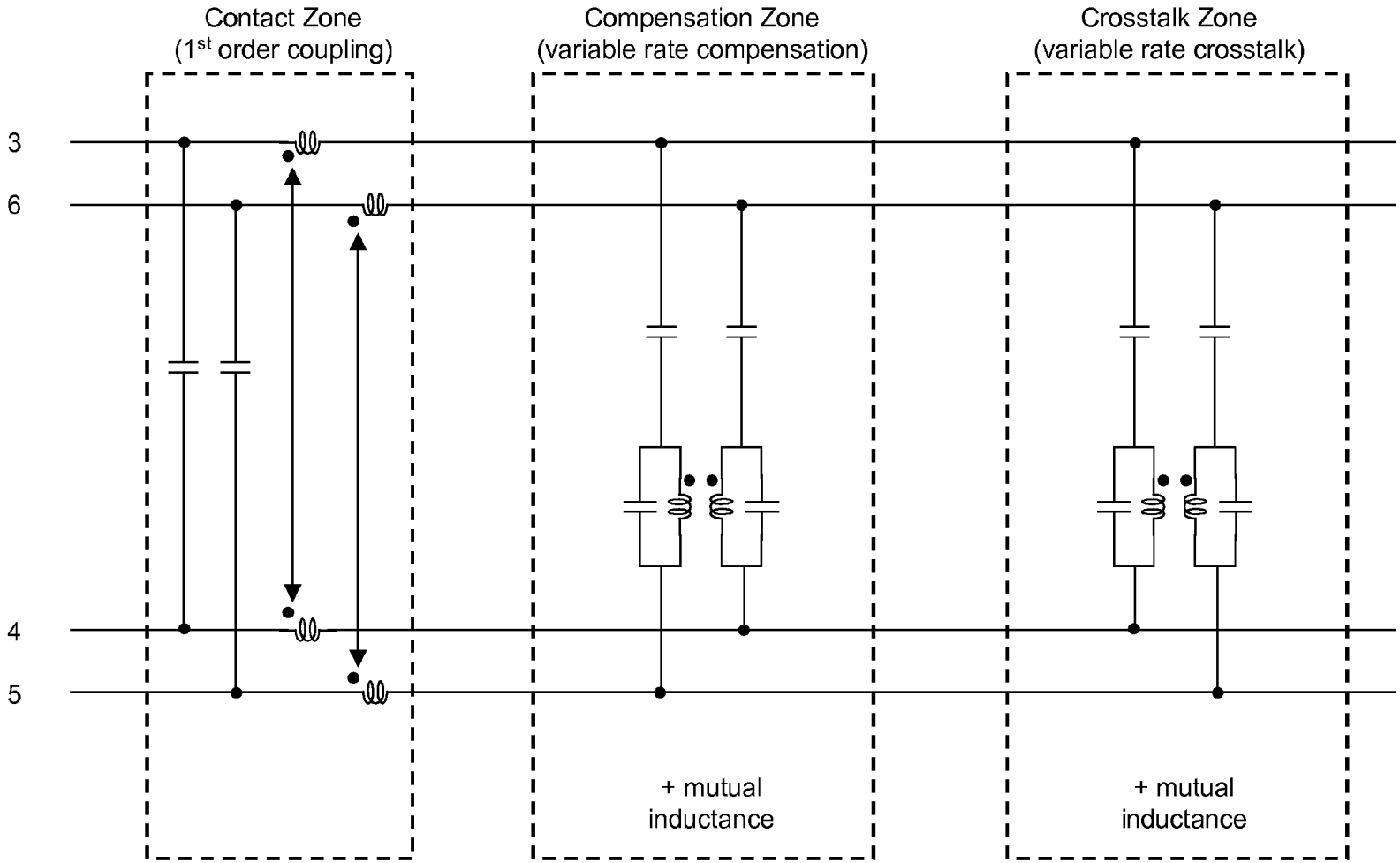
FIGS. 20-21 show jacks containing a parallel resonant circuit containing negative or positive mutual inductance in the compensation and crosstalk zones.
Figure 21:
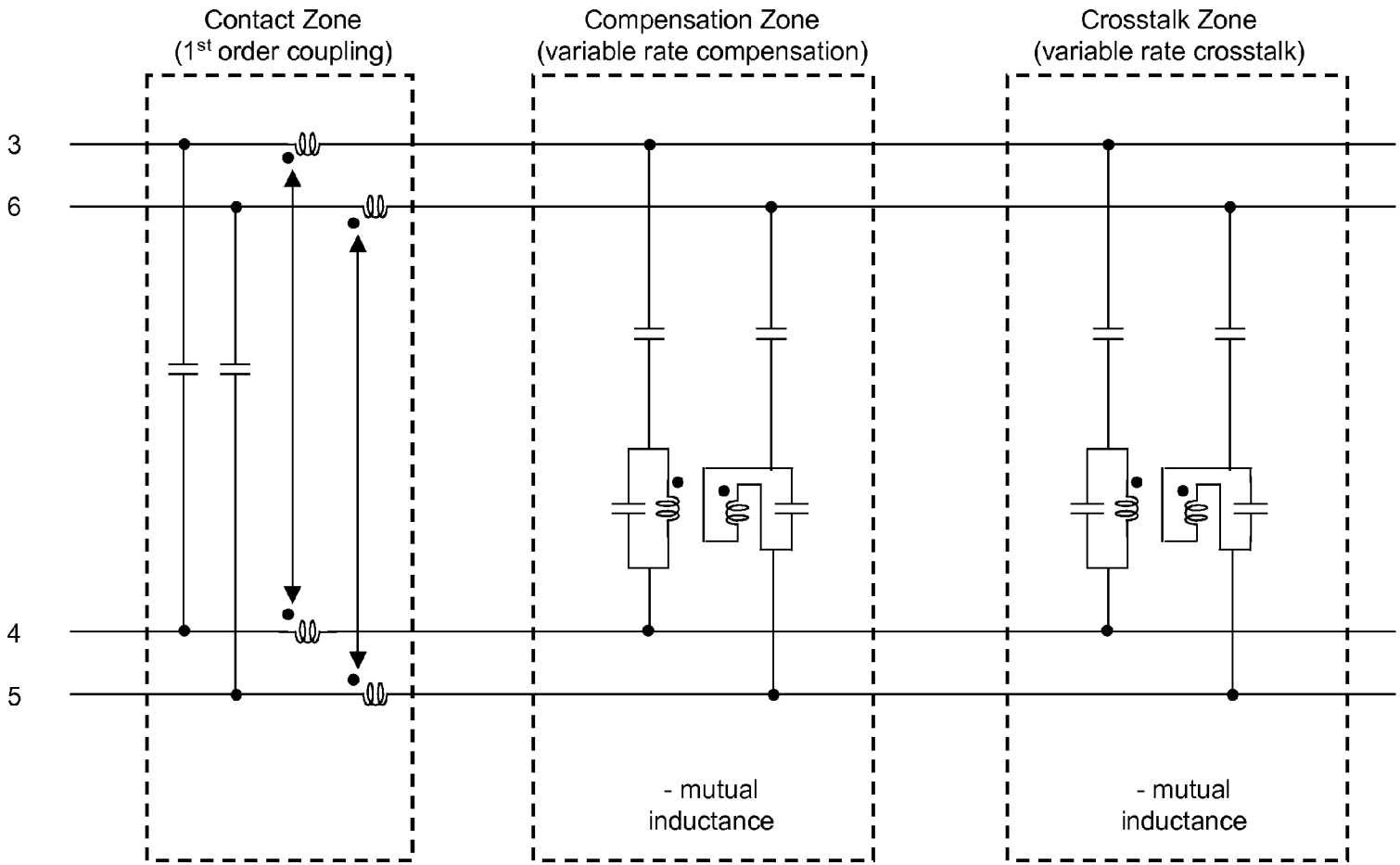
Figure 22:
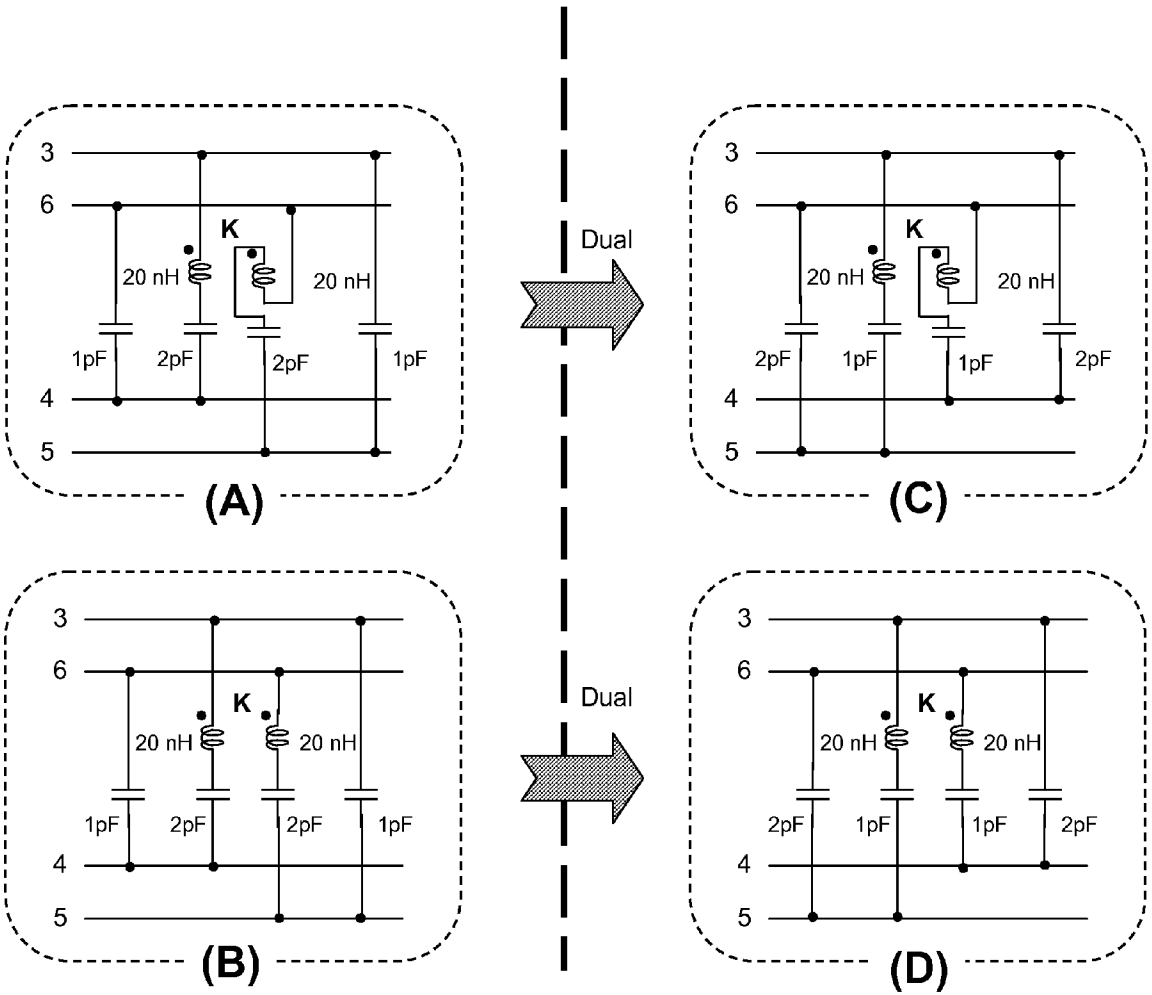
FIGS. 22-23 show dual lattice networks having crosstalk vectors and compensation vectors, respectively, with different frequency characteristics.
Figure 23:
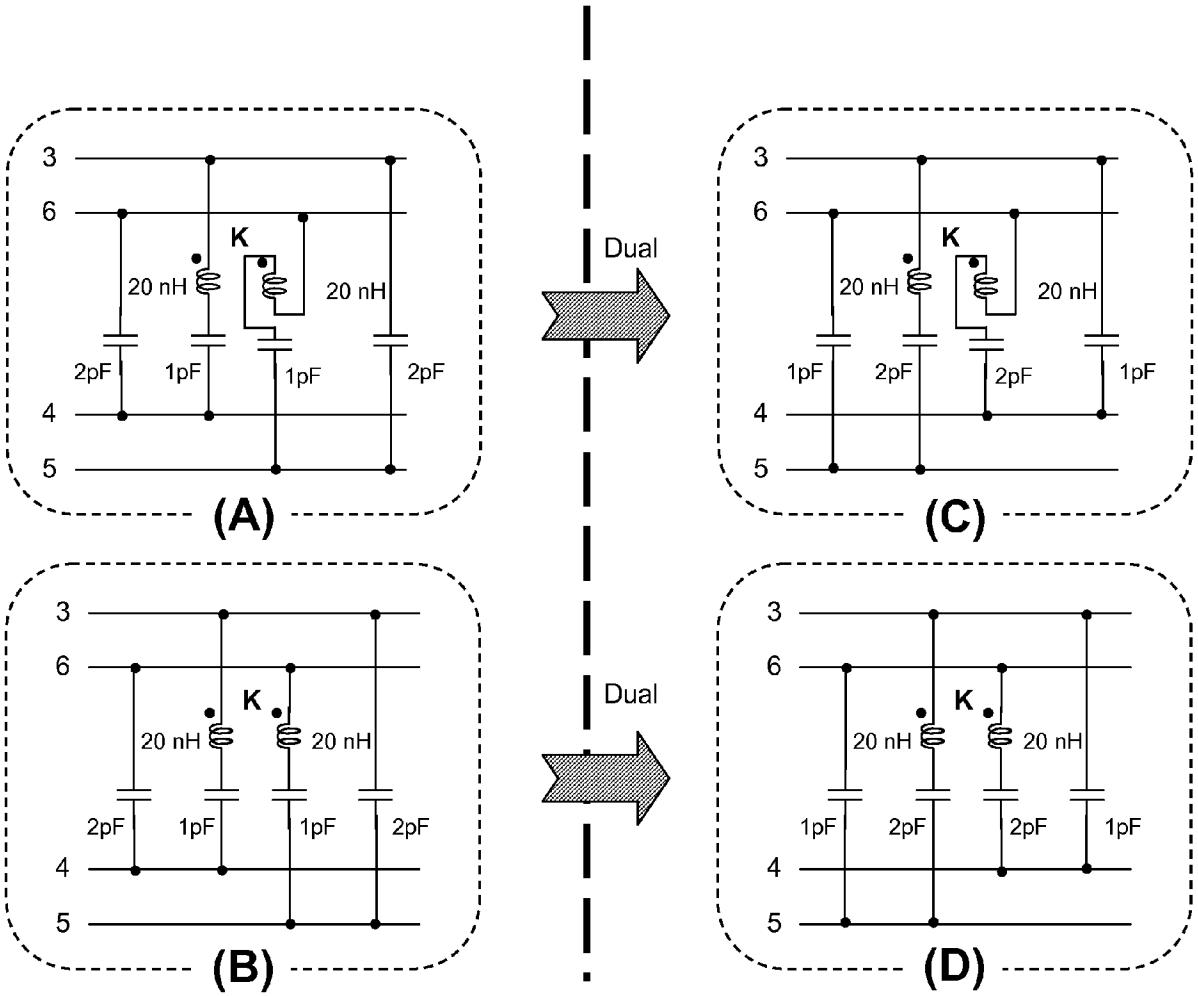

FIGS. 15-23 show various multi-zone configurations that make use of negative or positive mutual inductance. The mutual inductance can be implemented in one or both of the compensation and crosstalk zones. If mutual inductance is employed in both the compensation and crosstalk zones, the mutual inductance can either be negative or positive in both zones or negative in one zone and positive in the other zone. FIGS. 15-19 illustrate embodiments of three-zone jacks in which series LC circuits are employed in the compensation and crosstalk zones. FIGS. 20 and 21 illustrate embodiments of three-zone jacks in which parallel resonant circuits are employed in the compensation and crosstalk zones. Each parallel resonant circuit contains a parallel combination of an inductor and a capacitor. As with the series LC circuit configurations, the parallel resonant circuits can be in one or both of the compensation and crosstalk zones and may use a self inductance alone or may include a mutual inductance. The inductor in each parallel resonant circuit in the embodiments of FIGS. 20 and 21 contains a mutual inductance. The coupling between each pair of conductors contains a parallel resonant circuit in series with a blocking capacitor. In general, a combination of parallel resonant circuits and series LC circuits may be used in different zones or in the same zone in a jack. FIGS. 22 and 23 illustrate duals of lattice networks containing mutual inductances. As shown in FIGS. 7 and 8, and discussed above, each lattice network provides a vector (compensation or crosstalk) depending on the configuration of the lattice network and the values of the individual elements within the lattice network. The dual of a lattice network provides a dual lattice network vector whose relative magnitude changes with frequency in a direction opposite to the relative magnitude of the lattice network vector in the area of interest. Thus, for example, if a particular lattice network provides a crosstalk vector whose relative magnitude increases with increasing frequency in the area of interest, the dual of the particular lattice network provides a dual crosstalk vector whose relative magnitude decreases with increasing frequency.

The use of a lattice network in the compensation zone and/or the crosstalk zone can enhance the crosstalk performance of the jack. Each lattice network can include one or more series LC circuits and/or one or more parallel resonant circuits. The inductors in the lattice network can include self inductance and/or mutual inductance. The lattice network can be provided using traces on a PCB, discrete components, and/or by shaping the jack spring contacts. The material properties of the PCB containing the lattice network can be enhanced through the use of a high permeability material or a material with a frequency dependency in the PCB. The circuits in each lattice network may be disposed in various crosstalk and compensation configurations and the values of the circuit elements in the circuits may be selected to provide the desired jack characteristics.

The invention claimed is:

1. A jack for use in a plug-jack combination in a communication system, the plug including plug contacts, said plug-jack combination having a frequency range of operation, said jack comprising:

plug interface contacts for making an electrical connection with respective plug contacts;

at least one printed circuit board connected to said plug interface contacts;

a first coupling zone in at least one of said plug and said plug interface contacts having a first crosstalk magnitude with a first order magnitude increasing with increasing frequency;

a second coupling zone in said at least one printed circuit board having a second crosstalk magnitude with a first order magnitude increasing with increasing frequency;

a third coupling zone in said at least one printed circuit board, said third coupling zone having a first compensation element with a first compensation magnitude increasing slower with said frequency than said first order magnitude.

2. The jack of claim 1, wherein said third coupling zone includes a lattice network.

3. The jack of claim 2, wherein said lattice network includes an inductance and a capacitance in series between two conductor pairs and a shunt capacitance between two other conductor pairs.

4. The jack of claim 2, wherein said lattice network includes both a crosstalk element and a compensation element.

5. The jack of claim 4, wherein said crosstalk element has a higher order increase with frequency when compared to said compensation element; and overall compensation magnitude is greater than overall crosstalk magnitude.

6. A jack for use in a plug-jack combination in a communication system, the plug including plug contacts, said plug-jack combination having a frequency range of operation, said jack comprising:

plug interface contacts for making an electrical connection with respective plug contacts;

at least one printed circuit board connected to said plug interface contacts;

a first coupling zone in at least one of said plug and said plug interface contacts having a first crosstalk magnitude with a first order magnitude increasing with increasing frequency;

a second coupling zone in said at least one printed circuit board having a second crosstalk magnitude with a first order magnitude increasing with increasing frequency;

a third coupling zone in said at least one printed circuit board, said third coupling zone having a first crosstalk element with a first crosstalk magnitude increasing faster with said frequency than said first order magnitude.

7. The jack of claim 6, wherein said third coupling zone includes a lattice network.

8. The jack of claim 7, wherein said lattice network includes an inductance and a capacitance in series between two conductor pairs and a shunt capacitance between two other conductor pairs.

9. The jack of claim 7, wherein said lattice network includes both a crosstalk element and a compensation element.

10. The jack of claim 9, wherein said compensation element has a higher order increase with frequency when compared to said crosstalk element; and overall crosstalk magnitude is greater than overall compensation magnitude.

11. A jack for use in a plug-jack combination in a communication system, said jack comprising:

plug interface contacts for making an electrical connection with plug contacts;

a near-end crosstalk zone including a compensation structure providing a first coupling having a first magnitude; and a compensation zone placed between said plug interface contacts and said near-end crosstalk zone in a signal pathway of said jack, said compensation zone including a second coupling having a second magnitude, a ratio of said first magnitude and said second magnitude varying with frequency.

* * * * *